United States Patent [19]

Hatta

[11] Patent Number: 4,928,150

[45] Date of Patent: May 22, 1990

[54] COPY APPARATUS HAVING PLURAL COPY SHEET DISCHARGE TRAYS FOR DIFFERENT SIZED COPY SHEETS

[75] Inventor: Yoshihiko Hatta, Osaka, Japan

[73] Assignee: Minolta Camera Kabushiki Kaisha, Osaka, Japan

[21] Appl. No.: 184,502

[22] Filed: Apr. 21, 1988

[30] Foreign Application Priority Data

| | | | |
|---|---|---|---|
| Apr. 23, 1987 | [JP] | Japan | 62-100273 |
| Aug. 7, 1987 | [JP] | Japan | 62-198478 |
| Aug. 7, 1987 | [JP] | Japan | 62-198479 |

[51] Int. Cl.[5] ..... G03G 21/00

[52] U.S. Cl. ..... 355/311; 355/319; 355/321

[58] Field of Search ..... 355/3 SH, 14 R, 14 SH, 355/311, 313, 318, 319, 321

[56] References Cited

U.S. PATENT DOCUMENTS

| | | | |
|---|---|---|---|
| 4,017,173 | 4/1977 | Komori et al. | 355/8 |
| 4,453,819 | 6/1984 | Wada et al. | 355/319 |
| 4,515,458 | 5/1985 | Masuda et al. | 355/14 SH X |
| 4,607,942 | 8/1986 | Koyama et al. | 355/14 SH X |
| 4,655,582 | 4/1987 | Okuda et al. | 355/14 R |
| 4,772,917 | 9/1988 | Tani | 355/14 SH |

FOREIGN PATENT DOCUMENTS 62-10667 11/1987 Japan .

*Primary Examiner*—Fred L. Braun

*Attorney, Agent, or Firm*—Burns, Doane, Swecker & Mathis

[57] ABSTRACT

A copying machine for carrying out simplex, duplex and composite copying operations, wherein a sheet is re-fed to an image forming section in a duplex or composite copying mode. The machine includes two sheet discharge sections, a size evaluating device for judging the size of a sheet in the course of sheet transport, and a reversible roller pair disposed adjacent one of the discharge sections. When the sheet has a size fit for re-feeding for a second image formation in the duplex copying mode, the reversible roller pair is controlled to re-feed the sheet in a switchback fashion to the image forming section. When the sheet is too small, the reversible roller pair discharges the sheet through to the discharge section.

6 Claims, 35 Drawing Sheets

FIG. 7ℓ
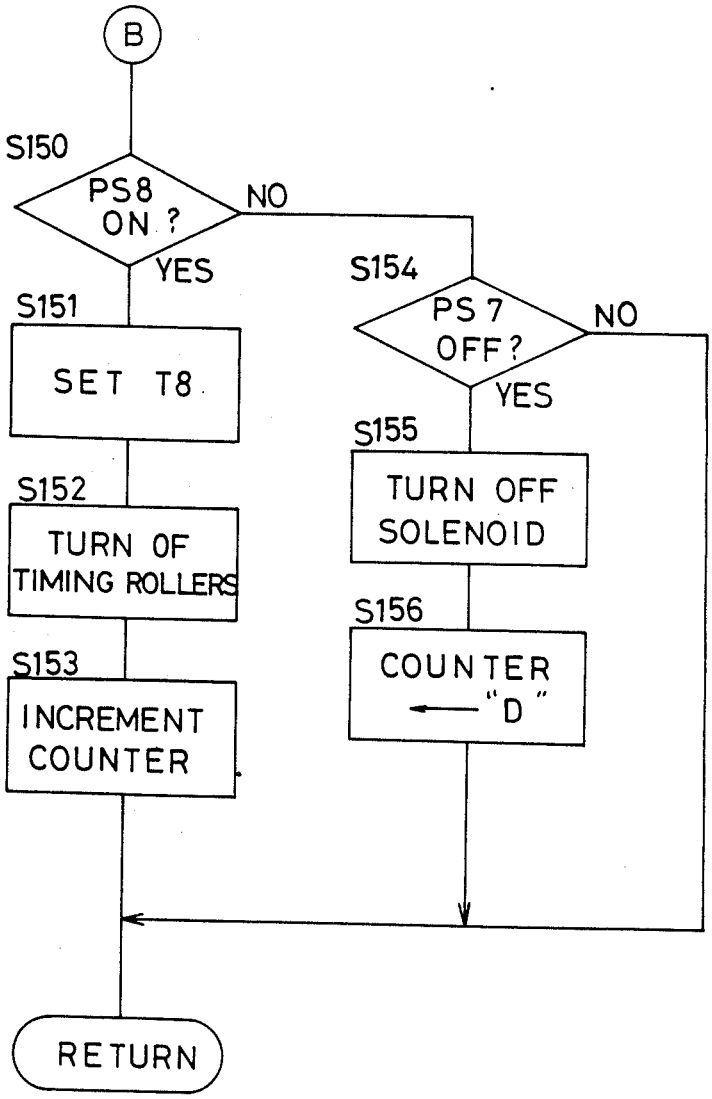

FIG. 9ℓ
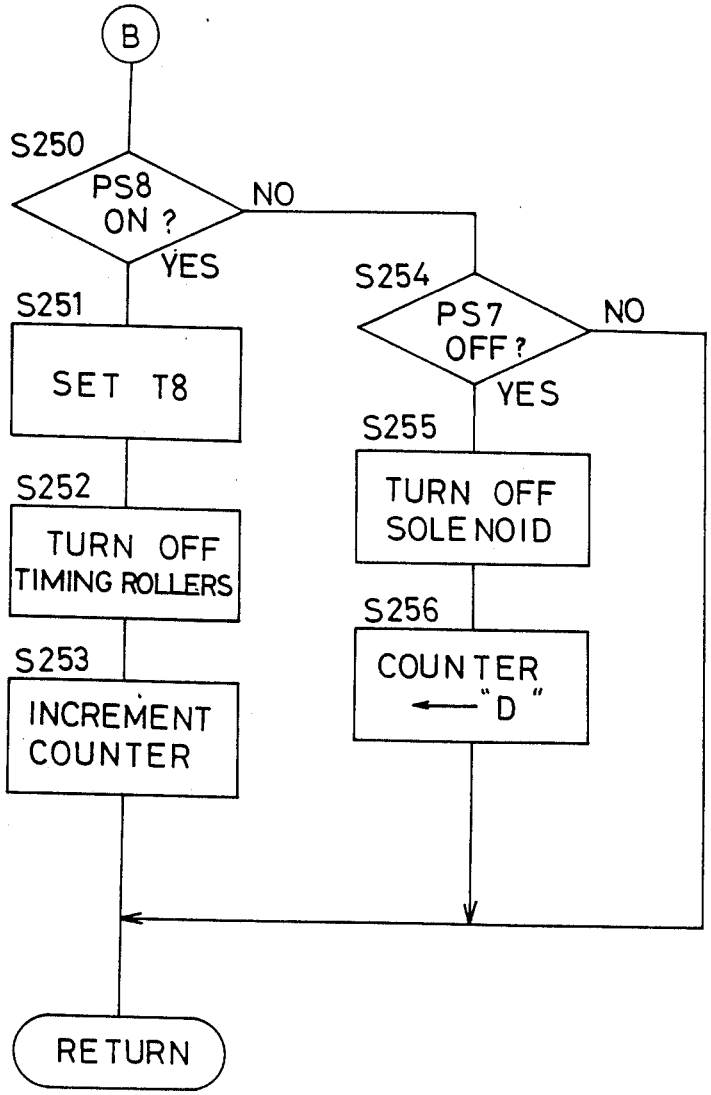

COPY APPARATUS HAVING PLURAL COPY SHEET DISCHARGE TRAYS FOR DIFFERENT SIZED COPY SHEETS

BACKGROUND OF THE INVENTION

1. FIELD OF THE INVENTION

The present invention relates to an image forming apparatus, particularly an electrophotographic copying apparatus, comprising a sheet re-feed mechanism for feeding a copy sheet having one side formed with an image by an image forming section to the image forming section again, and a mechanism for detecting the size of the sheet having one side formed with the image and forcibly discharging the sheet when the sheet is unfit for transport by the sheet re-feed mechanism.

2. DESCRIPTION OF THE PRIOR ART

This type of copying apparatus is known from Japanese Patent Publication Kokai No. 62-10667, for example. The apparatus disclosed in this publication checks the size of a copy sheet fed thereto to find out if the sheet is fit for transport conditions of the sheet re-feed mechanism. When the sheet is judged unfit, the sheet is delivered to a discharge section after having one side thereof formed with a copy image instead of being fed to the re-feed mechanism. According to this construction, even if a duplex copying operation is commenced with a sheet having a size unfit for the re-feed mechanism, such a sheet is discharged outwardly through the discharge section after the sheet is formed with an image on one side thereof. Consequently, there is no possibility of a transport failure in a re-feed transport path due to the unfit copy sheet.

However, since the sheet rejected as unfit for the duplex copying is discharged through the discharge section to be stored on a tray, for example, the operator could inadvertently regard the sheet as having come through the duplex copying process. Particularly in carrying out a duplex copying operation by successively feeding copy sheets of different sizes, it is necessary to watch the action of the copying apparatus till completion of the copying operation or to pick up the discharged sheets to confirm that copies have been taken on their back faces. Furthermore, a serious problem may arise when a sorter or a finisher or autostapler is connected to the discharge section of the apparatus. The problem arises from the fact that the sheets, whether duplexed or rejected as unfit, are all delivered alike through the discharged section to the sorter or the finisher.

SUMMARY OF THE INVENTION

The object of the present invention is to provide a copying apparatus capable of a reliable differentiation during a duplex composite copying operation between a sheet processed properly and a sheet discharged with only one side thereof carrying an image because of being unfit in size.

The above object is fulfilled, according to the present invention, by an image forming apparatus comprising sheet feed means, size evaluating means for evaluating a size of a sheet transported by the sheet feed means, image forming means for forming an image on the sheet transported by the sheet feed means, sheet re-feed means for transporting the sheet having one side thereof formed with the image by the image forming means to the image forming means again, a first sheet discharge section for discharging the sheet, a second sheet discharge section provided separately from the first sheet discharge section, and control means for providing at least a sheet re-feed mode for transporting the sheet having one side thereof formed with the image by the image forming means to the image forming means again and then transporting the sheet to the first sheet discharge section, the control means being operable in the re-feed mode to deliver the sheet to the second sheet discharge section without delivering the sheet to the first sheet discharge section when the size evaluating means judges the sheet to be unfit for re-feed.

In the above construction, a copy sheet properly processed in the duplex or composite copying operation is delivered to the first discharge section whereas a sheet unfit for such an operation is delivered to the separate, second discharge section. Thus, the operator is able to readily recognize the sheet incompletely processed in the duplex or composite copying operation.

This feature has a further advantage in that, where a sheet handling device such as a sorter or a finisher is attached to the apparatus, by connecting it to the first discharge section, the sheet handling device is safeguarded against any inconvenience or operational failure due to delivery of sheets unfit in size for the duplex or composite copying operation.

The foregoing and other objects, features and advantages of the invention will be apparent from the following more particular description of preferred embodiments of the invention, as illustrated in the accompanying drawings.

DESCRIPTION OF THE PREFERRED EMBODIMENTS

FIRST EMBODIMENT

A copying machine, which is one example of image forming apparatus according to the present invention, will be described first with reference to the drawings.

OVERALL CONSTRUCTION AND OPERATION OF THE COPYING MACHINE

Figure 1A:
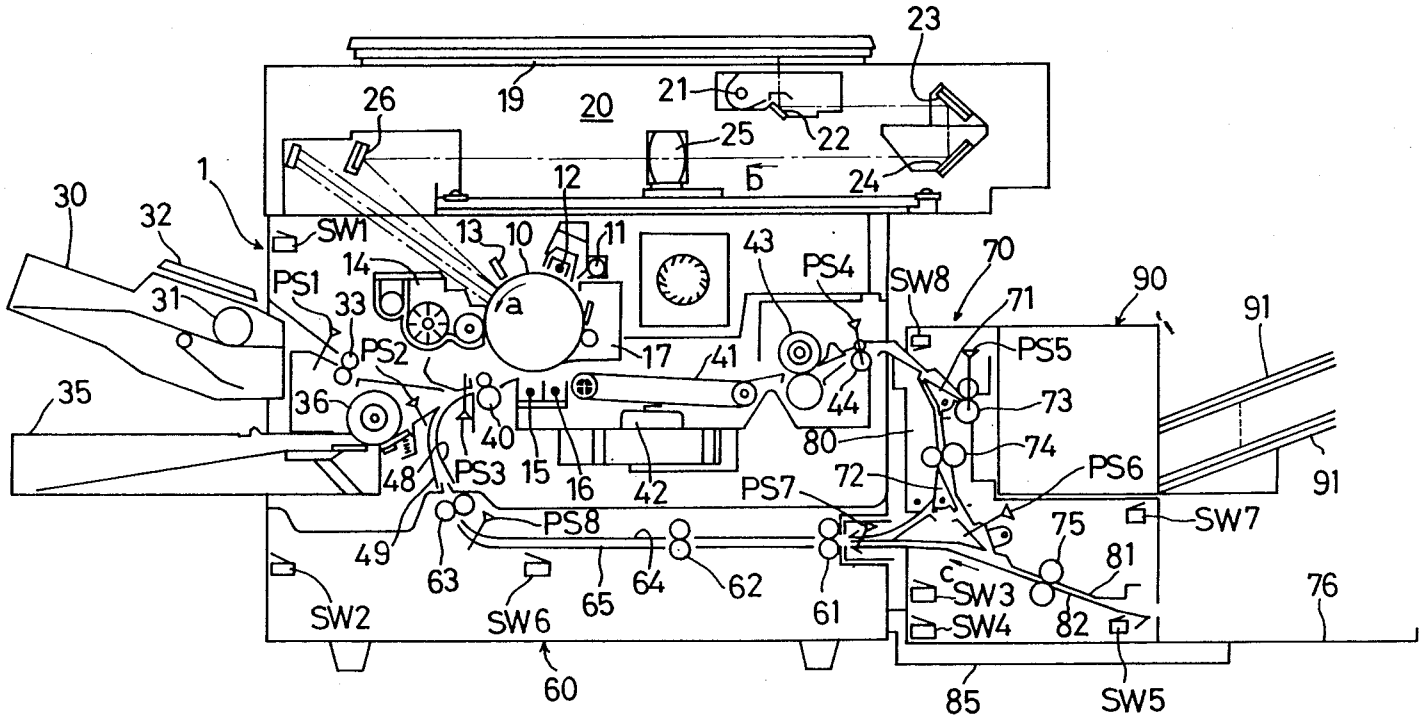
FIG. 1A is a schematic view of a copying apparatus with a sorter which is one example of image forming apparatus according to one embodiment of the present invention.

Referring to FIG. 1A showing the entire copying machine, a main body 1 includes a horizontal transport unit 60 in a lower region thereof for re-feeding copy sheets, a paper supply section at a lefthand lateral face thereof, and a vertical transport unit 70 and a sorter 90 disposed at a righthand lateral face thereof.

The main body 1 houses a photoreceptor drum 10 approximately in a central position thereof for rotation in the direction of arrow a at a fixed peripheral velocity V. The drum 10 is surrounded by a main eraser 11, a corona charger 12, a sub-eraser 13, a developing device 14 of the magnetic brush type, a transfer charger 15, a sheet separating charger 16, and a cleaning device 17 of the blade type arranged in the mentioned order. The photoreceptor drum 10 carries a layer of a known photosensitive material on its surface. With a rotation of the drum 10 in the direction of arrow a for each copy run, the main eraser 11, corona charger 12 and sub-eraser 13 carry out charge dissipation, charging, and charge dissipation from unnecessary portions, respectively, and the drum surface is exposed to an image projected by an optical system 20 whereby an electrostatic latent image is formed on the drum surface. This latent image is turned into a toner image at the developing device 14.

The optical system 20 is disposed under a document supporting glass plate 19 for scanning a document placed on the glass plate 19. The optical system 20 includes an exposure lamp 21, a first mirror 22, a second mirror 23, a third mirror 24, a projecting lens 25 and a fourth mirror 26. The exposure lamp 21 and first mirror 22 are formed into an integral unit movable in a direction of arrow b at a velocity V/m (m being a rate of copy magnification) with respect to the peripheral velocity V of photoreceptor drum 10 which is constant whether a copy is taken in real-size or in magnification. The second mirror 23 and third mirror 24 are also formed into a unit movable in the direction of arrow b at a velocity V/2 m. When varying the rate of copy magnification, the projecting lens 25 is moved along an optical axis and the fourth mirror 26 is moved and oscillated to adjust an optical path.

Copy sheets are contained in a fixed type autofeed cassette 30 and a detachable autofeed cassette 35 in the paper supply section at the lefthand face of the main frame 1. The sheets are fed one by one into the copying machine by selectively rotatable paper feed rollers 31 and 36. An upper face of cassette 30 defines a manual paper feed portion 32 from which sheets may be manually fed. The sheet fed from the cassette 30 or the manual feed portion 32 is transported through a paper feed roller pair 33 to a timing roller pair 40. The sheet fed from the cassette 35 proceeds directly to the timing roller pair 40. In either case, the sheet is stopped temporarily at the timing roller pair 40 and is fed to a transfer section in synchronism with an image formation of the surface of photoreceptor drum 10. The sheet is then brought into contact with the photoreceptor drum 10 for transfer of the toner image onto the sheet by corona discharge at the transfer charger 15. The sheet is separated from the photoreceptor drum 10 by an AC corona discharge at the separating charger 16 and by the stiffness of the sheet itself. Thereafter, the sheet is transported as drawn to a conveyor belt 41 by an air suction device 42, to a fixing device 43 where the toner image is fixed to the sheet. Finally, the sheet is discharged through a discharge roller pair 44.

The photoreceptor drum 10 having the toner image transferred from its surface is stripped of toner particles and electric charge remaining on its surface by the cleaning device 17 and main eraser 11 to be ready for a next copy run.

CONSTRUCTIONS OF VERTICAL AND HORIZONTAL TRANSPORT UNITS

Figure 1B:
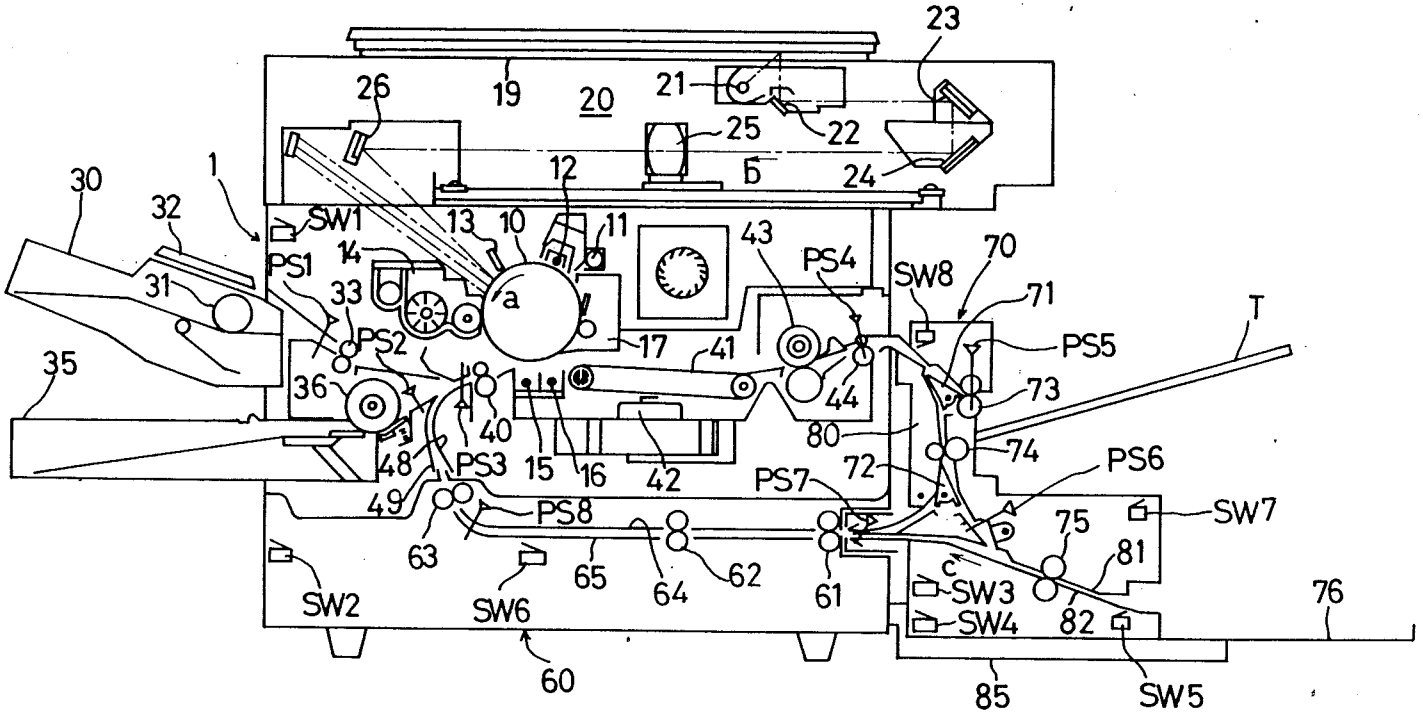
FIG. 1B is a schematic view of the copying apparatus shown in FIG. 1A, with the sorter replaced by a tray.

In FIG. 1A, the vertical transport unit 70 is mounted on a rail 85 fixed to the main body 1. This transport unit 70 includes a first switching blade 71, a second switching blade 72, a discharge roller pair 73, a transport roller pair 74, a reversible transport roller pair 75, guide plates arranged adjacent these elements for defining a sheet passage, and a discharge tray 76. The sorter 90 having a plurality of bins 91 is located at the righthand side of the vertical transport unit 70. This sorter 90 may be replaced by a tray T as shown in FIG. 1B.

The horizontal transport unit 60 includes transport roller pairs 61, 62 and 63, and an upper and a lower guide plates 64 and 65 disposed adjacent these rollers for defining a sheet passage. A sheet delivered through the vertical transport unit 70 is transported by the transport roller pairs 61, 62 and 63 through guide plates 48 and 49 in the main body 1 to be re-fed to the timing roller pair 40.

Three copying modes are available for the operation of the described copying machine, which are an ordinary, simplex copying mode, a duplex copying mode and a composite copying mode. In addition, a forcible discharge mode is taken, in the duplex and composite copying modes, to discharge the sheet through the transport roller pair 75 onto the discharge tray 76 when the sheet is of a size not fit for re-feed. The forcible discharge mode will be described next.

In the simplex copying mode, or when a sheet is fed a second time in the duplex and composite copying modes, the first switching blade 71 is set to the solid line position in the drawings. Consequently, the sheet transported by the discharge roller pair 44 in the main body 1 is delivered through the discharge roller pair 73 to the sorter 90 or the tray T.

When a sheet is fed for the first time in the duplex and composite copying modes, the first switching blade 71 is set to a position slightly displaced clockwise from the solid line position. As a result, the sheet is guided to the transport roller pair 74. In the duplex copying mode, the second switching blade 72 is set to the solid line position and the sheet is transported by the transport roller pair 75 in forward rotation to a position between guide plates 81 and 82. The sheet is temporarily stopped as nipped by the transport roller pair 75. When an unillustrated solenoid is energized, the transport roller pair 75 is driven backward to transport the sheet in the direction of arrow c in a switchback fashion onto the horizontal transport unit 60. Subsequently, the sheet is transported to the timing roller pair 40 to be subjected to the described copying operation for printing an image on the back face of the sheet.

In the composite copying mode, the second switching blade 72 is set to a position slightly displaced clockwise from the solid line position. As a result, the sheet is transported from the transport roller pair 74 directly to the horizontal transport unit 60. Thereafter, the sheet is transported to the timing roller pair 40 for superposing a second image on a first image on the front face thereof.

A sheet of a size unfit for re-feeding may be introduced for an operation in the duplex or composite copying mode. In this case, as described in detail hereinafter, the sheet carrying a copy image on one face thereof is transported through the transport roller pair 74 to the transport roller pair 75, at which time the latter roller pair 75 is maintained in forward rotation to discharge the sheet onto the discharge tray 76.

SHEET SENSORS

The copying machine according to this embodiment includes photosensors PS1-PS8 disposed at locations along the sheet transport path for detecting sheets as depicted in the drawings. Sensor PS1 detects sheets fed from the upper paper supply section. Sensor PS2 detects sheets fed from the lower paper supply section. Sensor PS3 detects sheets at a position immediately upstream of the timing roller pair 40. Sensor PS4 detects sheets discharged from the main body 1. Sensor PS5 detects sheets just before delivery to the sorter 90. Sensor PS6 detects sheets transported to the switchback section. Sensor PS7 detects sheets just before delivery to the horizontal transport unit 60. Sensor PS8 detects sheets to be re-fed to the main body 1.

Each of the sensors PS1-PS8 is turned on when the leading end of each sheet arrives and is turned off with passage of the rear end thereof.

Sensor PS3 disposed immediately upstream of the timing roller pair 40 acts also to detect sheet sizes (or lengths) in combination with a timer.

OPENING OF TRANSPORT PATHS

The copying machine further includes a switch SW1 for detecting opening and closing of a door of the main body 1, a switch SW2 for opening and closing of a door of the horizontal transport unit 60, switches SW3 and SW4 for detecting attachment and detachment of the vertical transport unit 70, and a switch SW7 for detecting attachment and detachment of the sorter 90.

Figure 2:
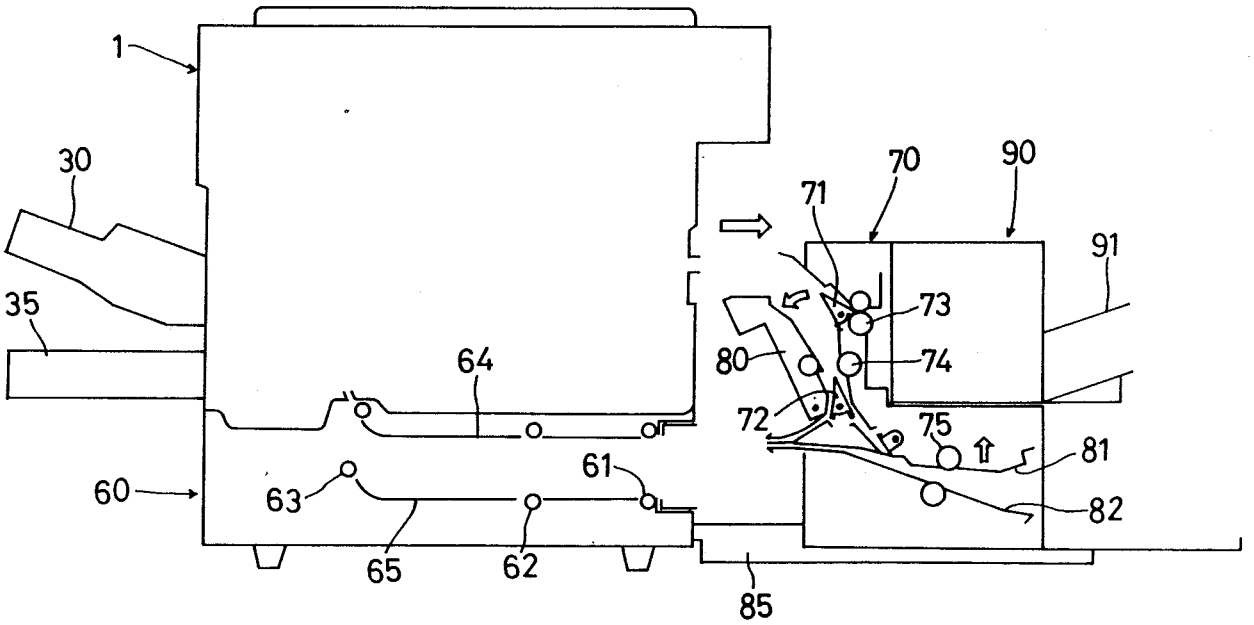
FIG. 2 is an explanatory illustration of the copying apparatus with a paper transport path opened.

The door of the main body 1 is opened for removal of a sheet trapped in the main body 1 and various other maintenance operations. The door of the horizontal transport unit 60 is opened solely for removal of a sheet trapped in a horizontal transport path. As shown in FIG. 2, the horizontal transport path may be opened by pressing down lower rollers of the transport roller pairs 61–63 and the lower guide plate 65. The opening and closing of the path are detected by a switch SW6.

The vertical transport unit 70 is detachable from the main body 1 by sliding the unit 70 along the rail 85, as shown in FIG. 2. When the unit 70 is detached, the switch SW3 outputs a power-off signal and switch SW4 outputs a signal to a CPU described hereinafter. The transport paths in the vertical transport unit 70 may be opened by turning the guide plates 80 and 81 in the directions indicated by arrows in FIG. 2. The opening and closing of these transport paths are detected by switches SW8 and SW5.

Where the tray T is provided in place of the sorter 90 as shown in FIG. 1B, the sheets discharged through the discharge roller pair 75 are stored on the tray T. In the other aspects, the copying machines of FIGS. 1A and 1B are identical and like reference numerals are affixed to like components without repeating the description of such components.

CONTROL CIRCUITRY

Figure 3:
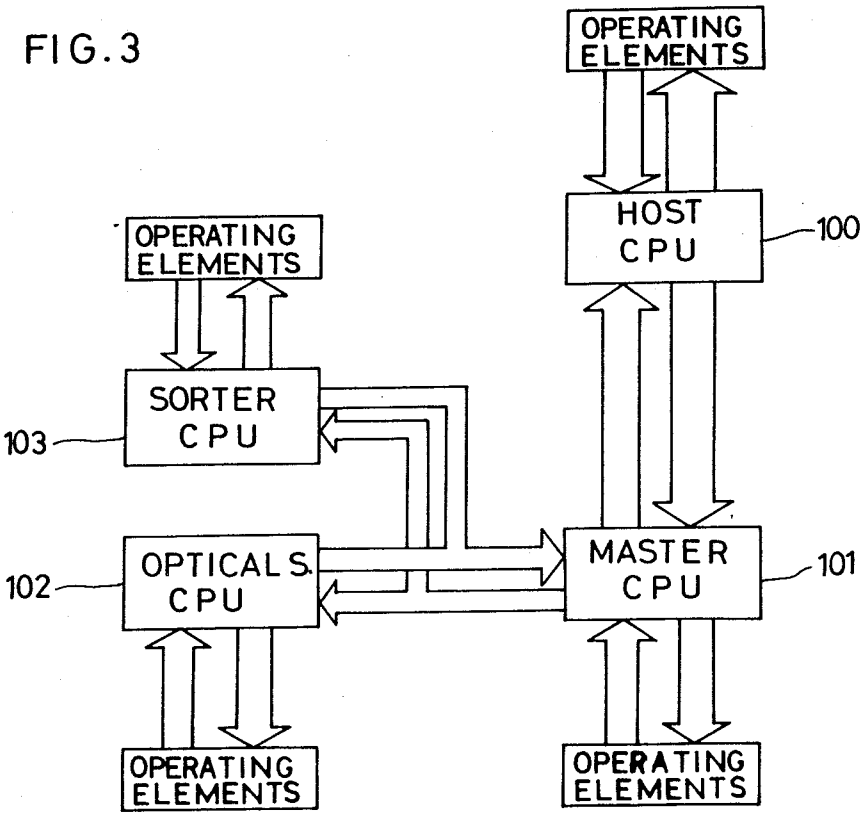
FIG. 3 is a block diagram of a control circuitry of the copying apparatus.

FIG. 3 is a block diagram of a control circuitry, which includes a host microcomputer (hereinafter referred to as CPU) 100, a master CPU 101 for controlling the components mounted in the main body 1, a CPU 102 for controlling the optical system 20, and a CPU 103 for controlling the sorter 90. CPU 100 and CPU 101 make serial data communications therebetween. CPU 101 make serial and parallel data communications with CPU 102 and CPU 103. CPU 100 processes inputs at a control panel and outputs based on the inputs, and transmits a copy request signal to CPU 101 in response to an ON-EDGE of a print key. The term "ON-EDGE" here means a transition from an "OFF" state to an "ON" state of a switch. In response to the output from CPU 100, CPU 101 effects a sequence control on the respective image forming elements and sheet transport units and transmits a scan signal to CPU 102. Upon receipt of the scan signal, CPU 102 controls the optical system 20 for image exposure and scanning. CPU 103 controls the sorter 90 in accordance with a sheet discharge signal received from CPU 101.

CONTROL SEQUENCE

Figure 4:
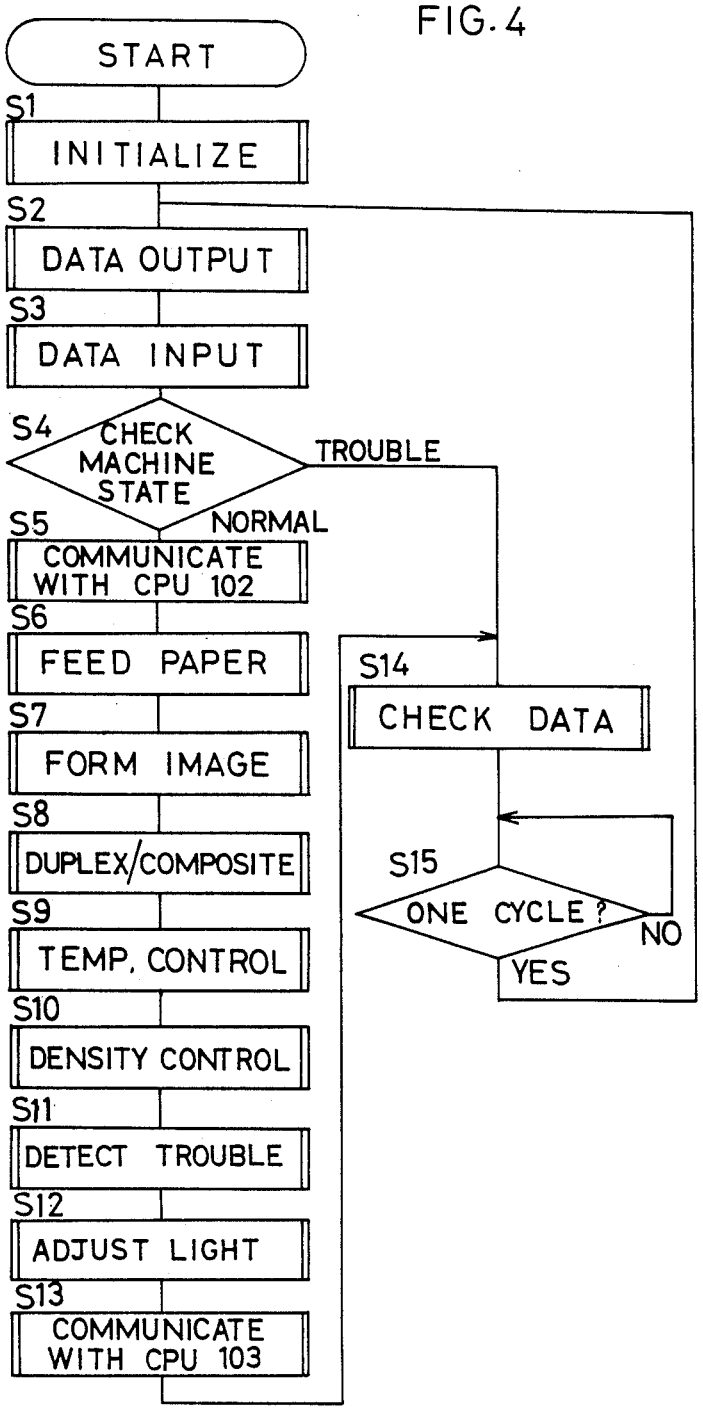
FIG. 4 is a flowchart of a main control routine.

FIG. 4 shows a main routine of CPU 101. When CPU 101 is reset and the program is started, step S1 clears a RAM and initializes various registers, counters and so on. Then, at step S2, data signals for the various operating components are given to output ports. At step S3, data input from keys and other elements on the control panel are processed.

At step S4, checking is made of the state of the copying machine. Here, positions of the doors, power-on and -off state and the like are checked. The program moves to step S14 if there is any trouble, and executes step S5 and subsequent steps if the machine state is found in order.

At step S5, the data communications with CPU 102 are processed and, at step S6, a paper feed operation is carried out in response to a copy request signal. Step S7 is for carrying out an image forming operation by driving a main motor, the developing device 14 and other associated devices. Step S8 carries out a paper transport operation in the duplex or composite copying mode. Step 9 carries out a temperature control operation for the fixing device 43. Step S10 carries out a control for regulating toner density in the developing device 14. Step S11 is for detecting troubles such as paper jamming. Step S12 is executed for adjustment of a quantity of light emitted from the exposure lamp 21. At step S13, the data communications with CPU 103 are processed and, at step S14, the data communications with CPU 100 are checked.

Step 15 checks whether or not one routine cycle of the main routine has been completed. If it has, the program returns to step S2.

Figure 5:
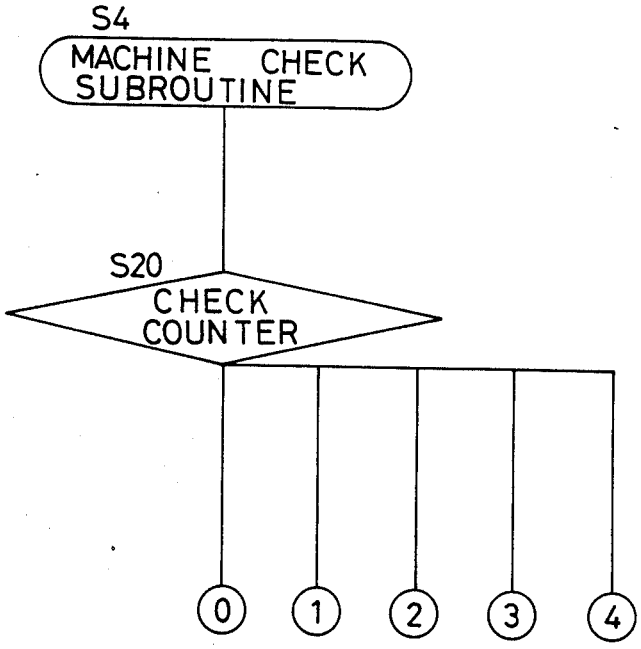
FIGS. 5 and 5*a* through 5*e* are a flowchart of a mechanical state subroutine.
Figure 5A:
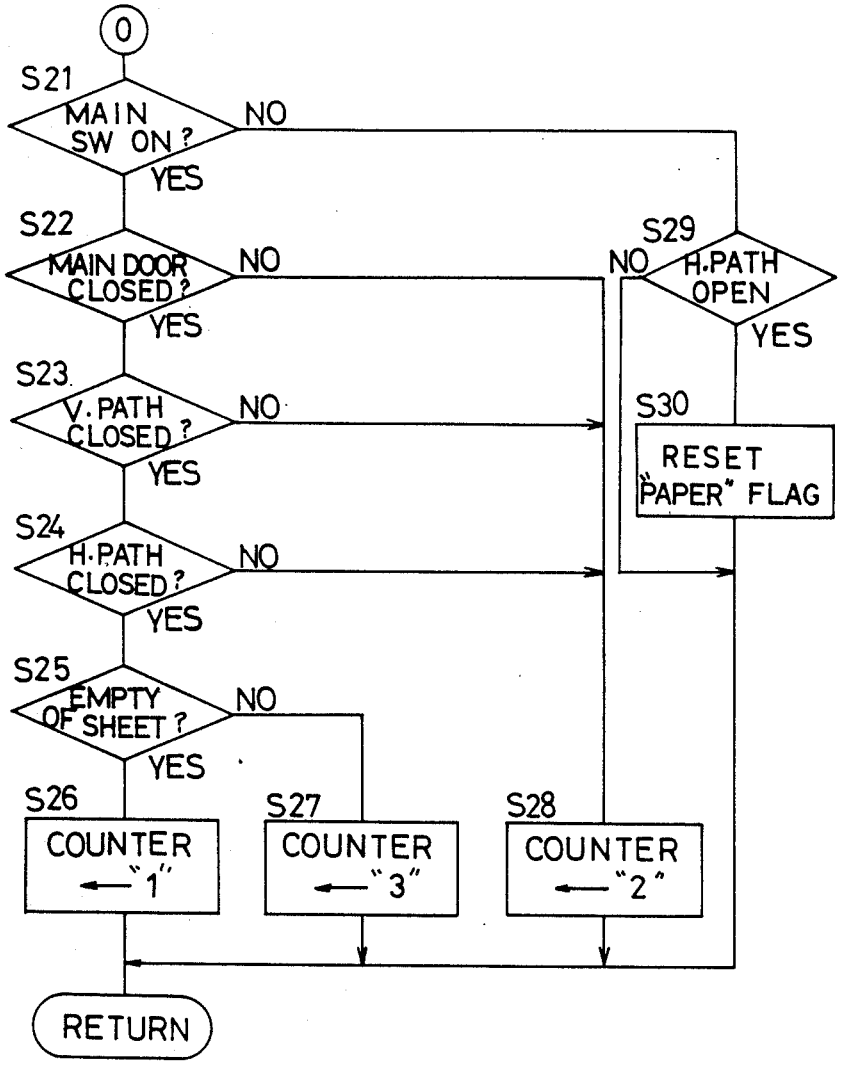

FIG. 5 shows a subroutine executed at step S4 for checking the state of the copying machine. The machine state includes opening and closing of the doors, presence or absence of a sheet trapped in the machine, whether power is turned on or not, and so on. These aspects are checked through counts of counters.

Referring to FIG. 5, step S20 checks a count of a machine state counter first. This counter is set to "0" to "4" and routines corresponding to these counts are executed as hereinafter described. The counter is initially set to "0".

If the counter is set to "0", the program moves to step S21 for checking whether a main switch of the copying machine is turned on, to step S22 for checking by means of the switch SW1 whether the door of main body 1 is closed, to step S23 for checking by means of the switches SW5 and SW8 whether the vertical transport path is closed, and to step S24 for checking by means of the switch SW6 whether the horizontal transport path is closed. If all of the above steps give results in the affirmative, step S25 checks whether a sheet remains in the copying machine. If no sheet is found in the machine, the machine state counter is incremented to "1" at step S26 and the program returns to the main routine. If there is a sheet in the machine, the counter is set to "3" at step S27.

If any of steps S22–24 gives a negative result, the program returns to the main routine after setting the counter to "2" at step S28.

If step S21 finds the main switch turned off, the program moves to step S29 for checking through the ON/-OFF state of switch SW6 whether the horizontal transport path is open. If the path is closed, the program just returns to the main routine. If it is open, the program returns to the main routine after resetting a "sheet-in-horizontal-path" flag at step S30. When this flag is reset, step S25 judges that there is a sheet remaining in the machine. The operations at steps S29 and S30 are carried out in order to avoid deterioration in sheet transport reliability. That is, these operations prevent a sheet waiting in the horizontal transport path for duplex or composite copying from getting displaced from a proper position in the path by the opening of the path.

Figure 5B:
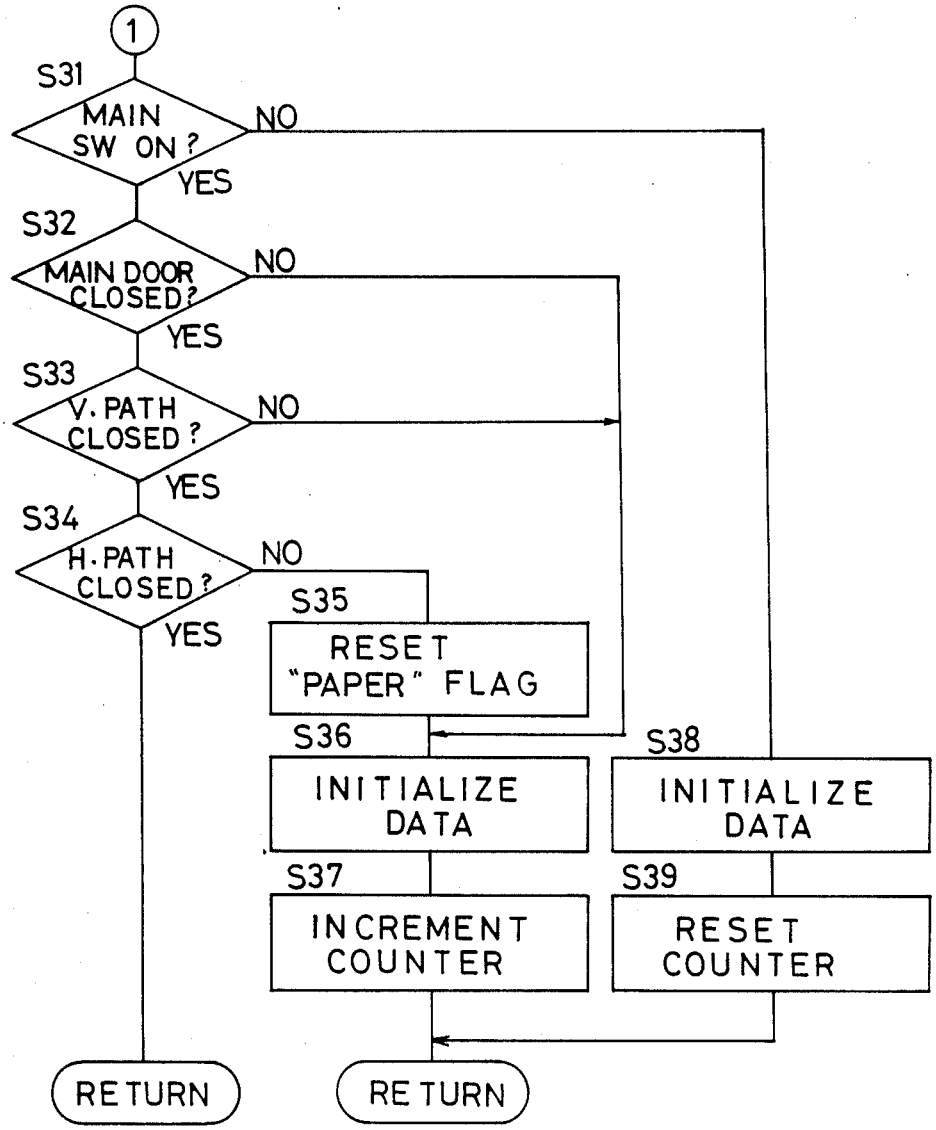

The machine state counter set to "1" is indicative of the main body 1 being in order for a copying operation. Then the program goes through a checking process at steps S31–34 in FIG. 5*b* similar to steps S21–24. If all of these steps give affirmative results, the program returns to the main routine. The return made straight from step S34 is of a normal time like the return made from step S24. However, a return made from step S37 or S39 described later is of a time of trouble. If step S34 finds the horizontal transport path opened, the "paper-in-horizontal-path" flag is reset as at step S30. Then, step S36 initializes the control data for the operating elements, step S37 increments the machine state counter to "2", and the program returns to the main routine.

If step S31 finds the main switch turned off, the program moves to step S38 for initializing the control data for the operating elements and to step S39 for resetting the machine state counter to "0", and returns to the main routine.

Figure 5C:
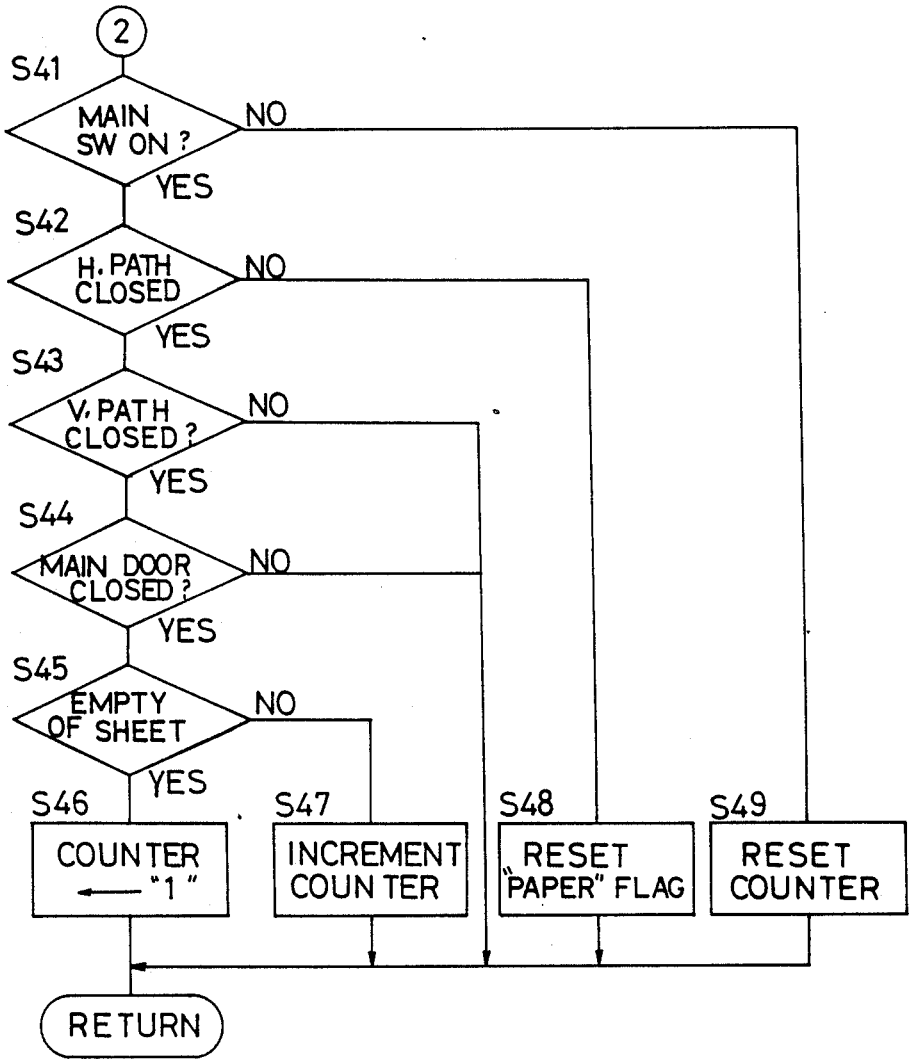

When the machine state counter is set to "2", the program moves to a trouble monitoring routine or to a standby routine for a copying operation in accordance with the state of the copying machine as shown in FIG. 5*c*.

More particularly, the program goes through a checking process at steps S41–44 as at steps S21–24 and S31–34. If all of these steps give affirmative results, whether or not a sheet remains in the machine is checked at Step S45. If there is no sheet, the program sets the machine state counter to "1" at Step S46 and returns to the main routine. If there is a sheet, the program increments the counter to "3" and returns to the main routine.

If either of steps S43 and S44 gives a negative result indicating that either the vertical transport passage or the door of the main body is open, the program just returns to the main routine. If Step S42 judges that the horizontal transport path is open, the program returns to the main routine after resetting the "sheet-in-horizontal-path" flag at Step S48 as it did at steps S30 and S35.

If Step S41 gives a negative result, the program returns to the main routine after resetting the machine state counter to "0" at Step S49.

Figure 5D:
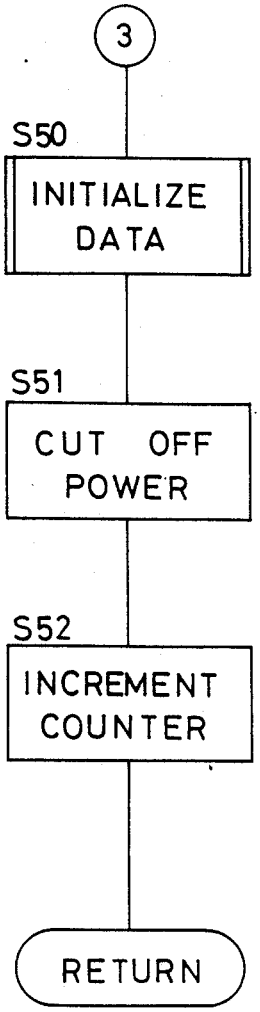

When the machine state counter is set to "3", the program executes a control routine for dealing with trouble as shown in FIG. 5*d*. It is to be noted that this counter is set to "3" not only at steps S27 and S47 but at Step S11 of the main routine when paper jamming or other trouble is detected.

Step S50 of this control routine first initializes control data for flags and the like other than all of the operating elements and the "sheet-in-horizontal-path" flag. Step S51 cuts off power supply to those elements consuming a large amount of current by turning off a relay to the copying machine. Then, Step S52 increments the machine state counter to "4" and the program returns to the main routine.

Figure 5E:
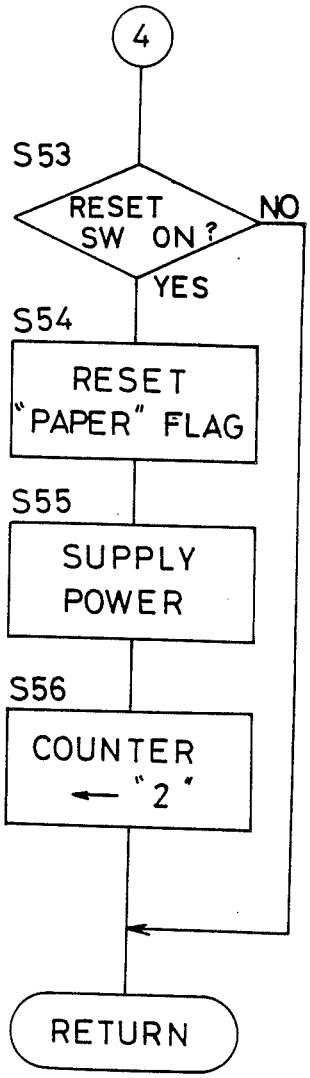

When the counter is set to "4", the program executes a control routine of FIG. 5*e* for completing removal of trouble such as paper jamming. In this routine, Step S53 checks whether a trouble reset switch is turned on or not. This switch is included in the unillustrated control panel, and is turned on by the operator after a trouble such as paper jamming is removed. If this switch is not turned on, the program returns to the main routine immediately. If the switch is turned on, Step S54 rests the "sheet-in-horizontal-path" flag and Step S55 resumes power supply by turning on the relay to the copying machine. Next, Step S56 sets the machine state counter to "2", whereupon the program returns to the main routine.

Figure 6:
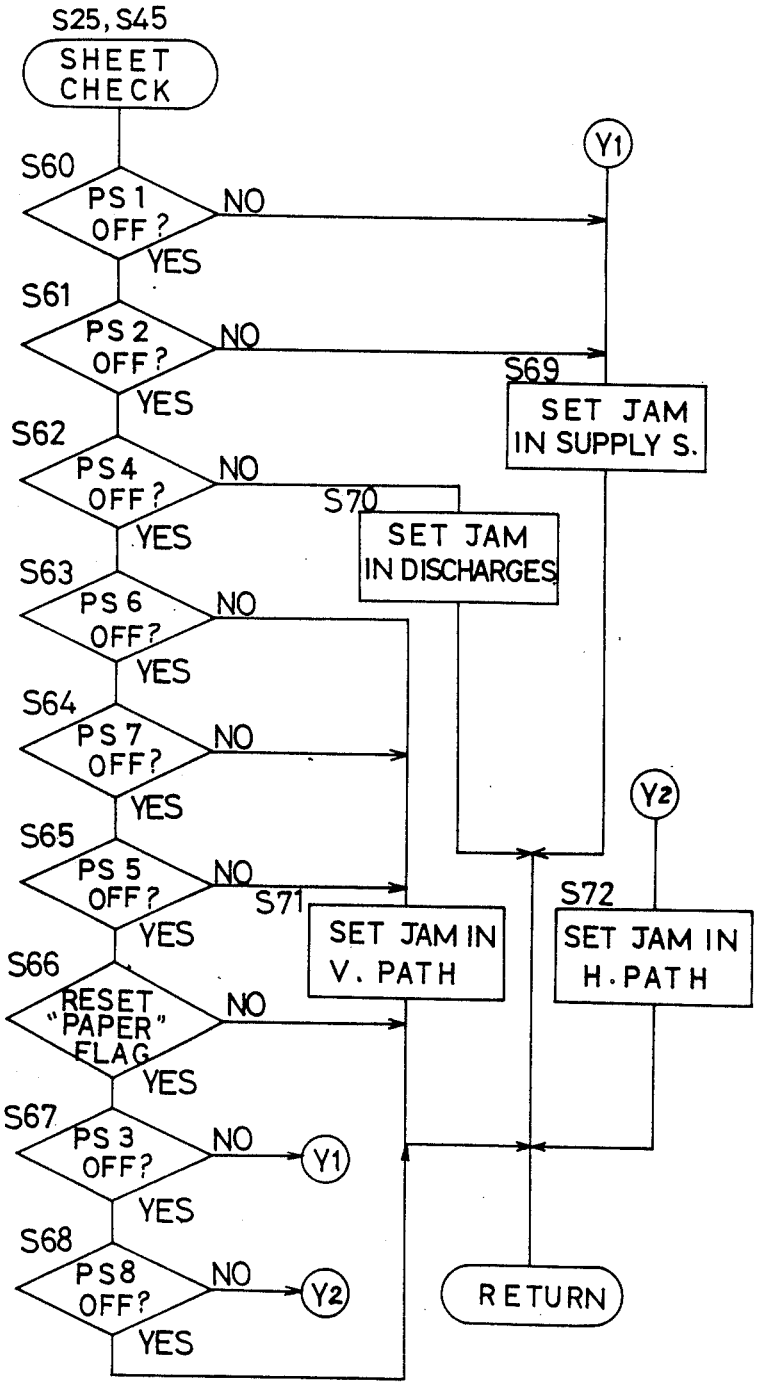
FIG. 6 is a flowchart of an internal sheet checking subroutine.

FIG. 6 shows a sheet checking subroutine executed at steps S25 and S45. This subroutine is for checking whether a sheet remains trapped in the copying machine before the machine assumes a standby state for a copying operation by the closing of the doors and turning on of the main switch.

First, whether a sheet remains in any of the sheet transport paths is checked at steps S60–65. More particularly, step S60 checks through sensor PS1 whether a sheet remains in the upper paper feed path up to the timing roller pair 40. Step S61 checks through sensor PS2 whether a sheet remains in the lower paper feed path up to the timing roller pair 40. Step S62 checks through sensor PS4 whether a sheet remains between the transfer section and the discharge roller pair 44. Step S63 checks through sensor PS6 whether a sheet remains in the vertical transport path or in the switch-back passage. Step S64 checks through sensor PS7 whether a sheet remains in the horizontal transport path.

If either of steps S60 and S61 finds sensor PS1 or PS2 turned on, the program moves to step S69 for making a setting that a sheet remains in the paper feed section, and returns to the main routine. If step S62 finds sensor PS4 turned on, the program moves to step S70 for making a setting that a sheet remains between the transfer section and discharge section of the main body 1, and returns to the main routine. If any of steps S63–65 finds sensor PS6, PS7 or PS5 turned on, the program moves to step S71 for making a setting that a sheet remains in the vertical transport unit 70, and returns to the main routine.

If steps S60–65 find all of the sensors turned off, step S66 checks whether the "sheet-in-horizontal-path" flag is reset or not. The program returns to the main routine if this flag is not reset, and moves to step S67 if it is reset. Step S67 checks through sensor PS3 whether a sheet remains adjacent the timing roller pair 40. If sensor PS3 is turned on, the program moves to step S69 for making a setting that a sheet remains trapped, and returns to the main routine. If not, the program moves to step S68 for checking through sensor PS8 whether a sheet remains between the horizontal transport path and the timing roller pair 40. If sensor PS8 is turned on, the program moves to step S72 for making a setting that a sheet remains trapped in the horizontal transport unit 60, and returns to the main routine. If sensor PS8 is off, the program just returns to the main routine.

Figure 7:
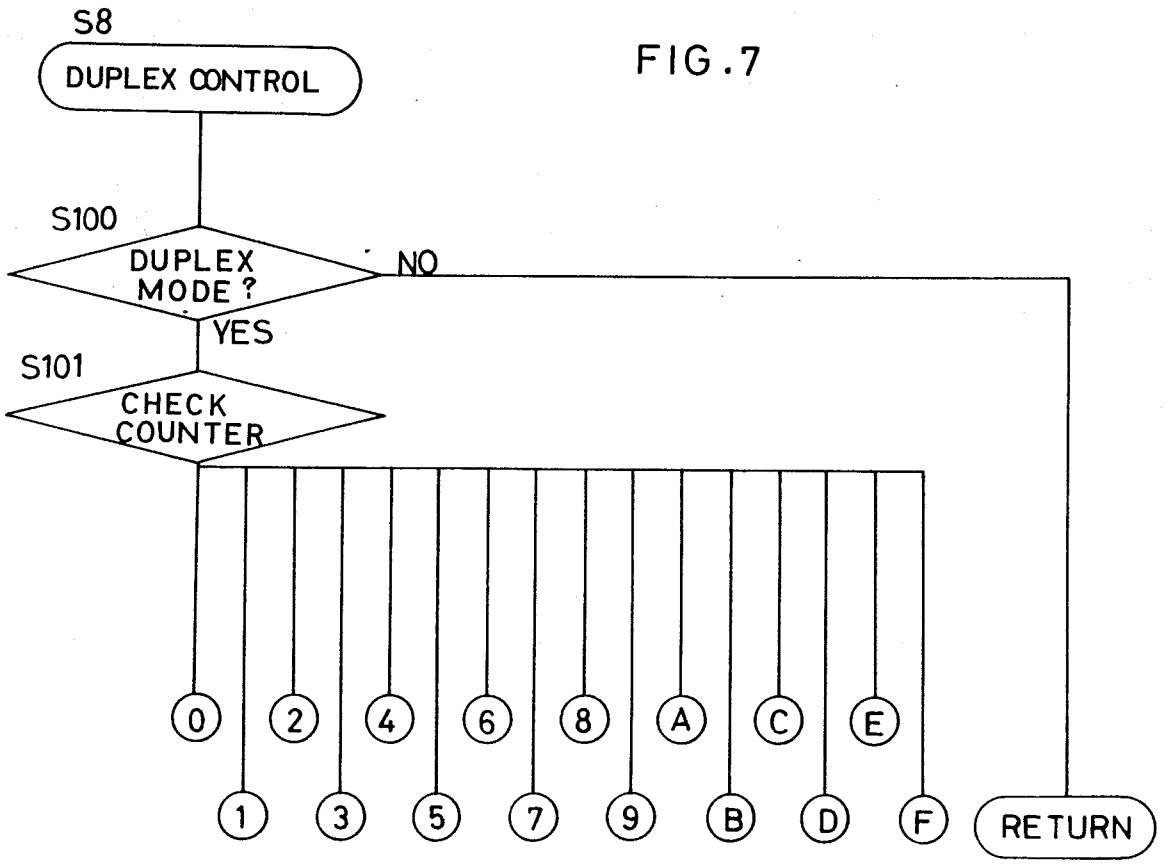
FIGS. 7 and 7*a* through 7*p* are a flowchart of a duplex copying control subroutine.
Figure 7A:
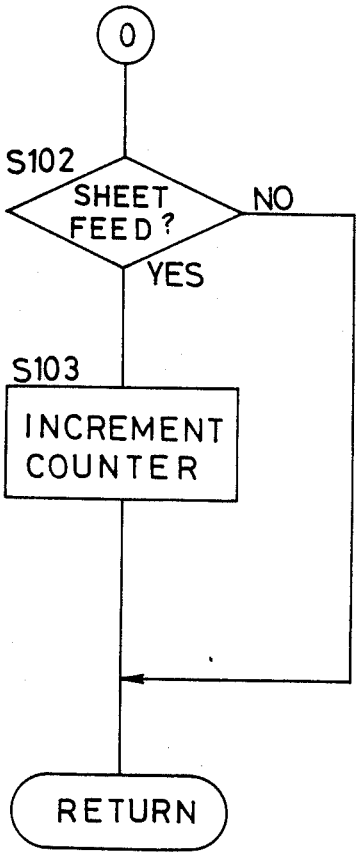
Figure 7B:
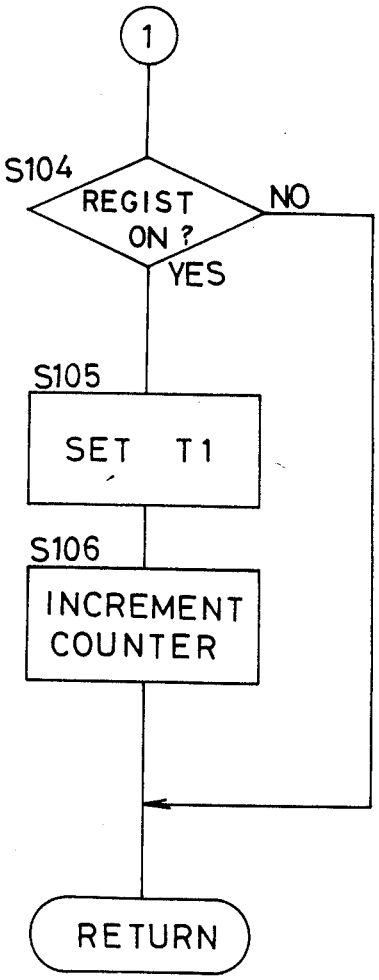
Figure 7C:
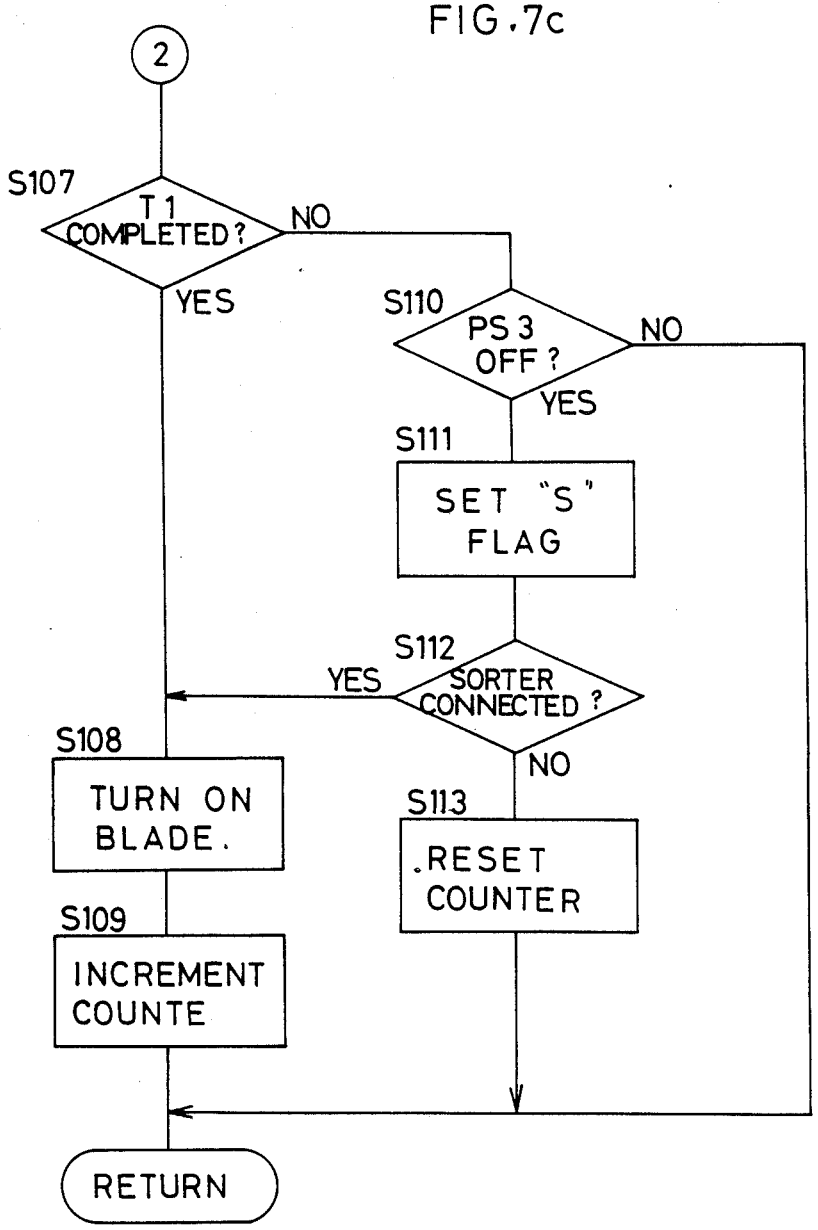
Figure 7D:
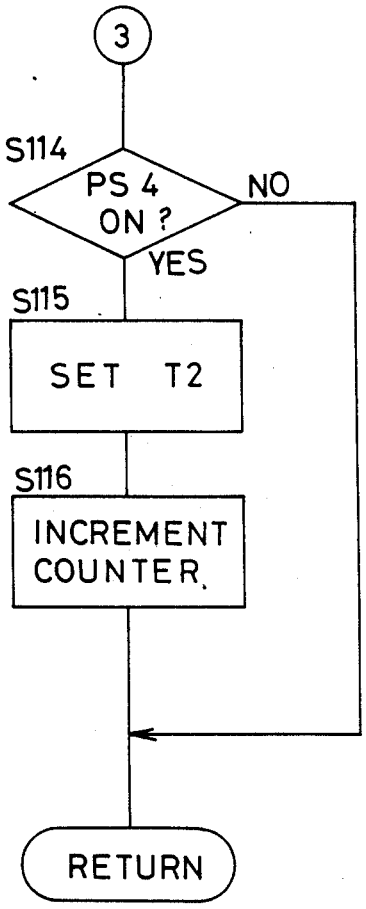
Figure 7F:
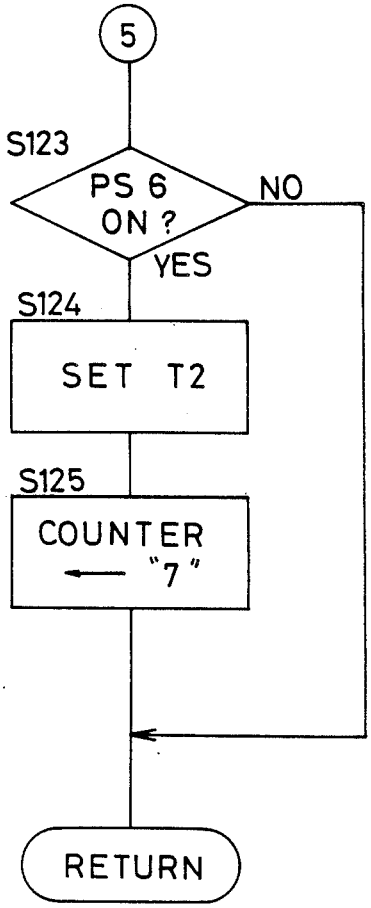
Figure 7E:
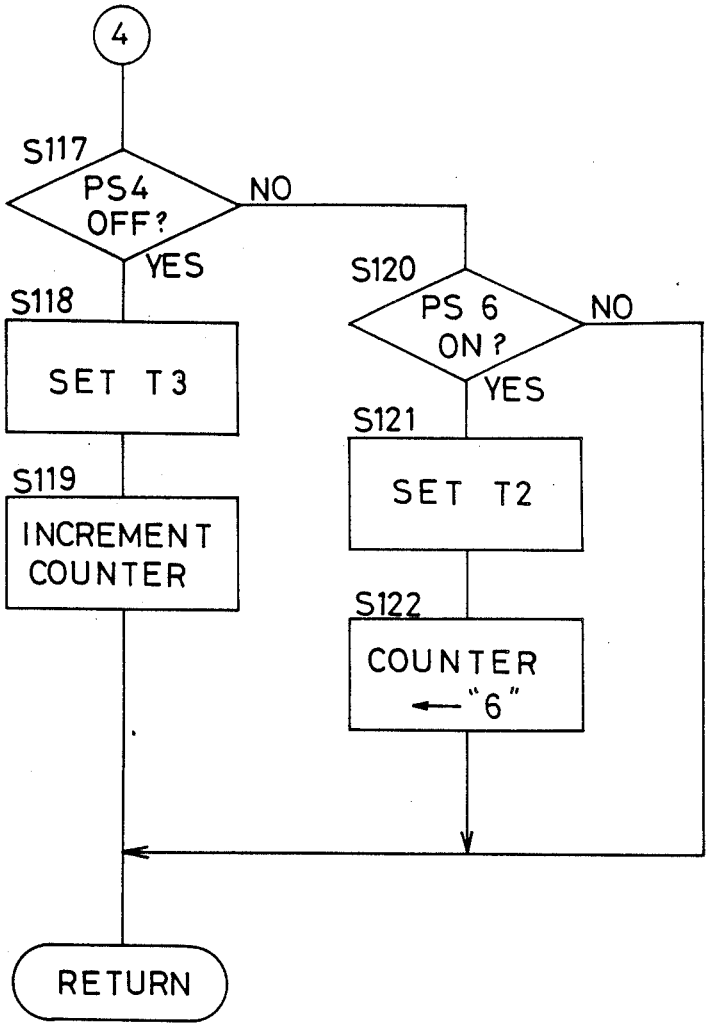
Figure 7G:
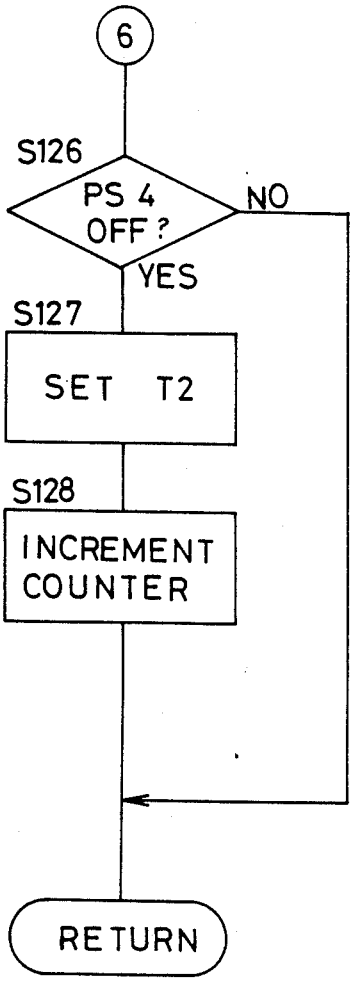
Figure 7P:
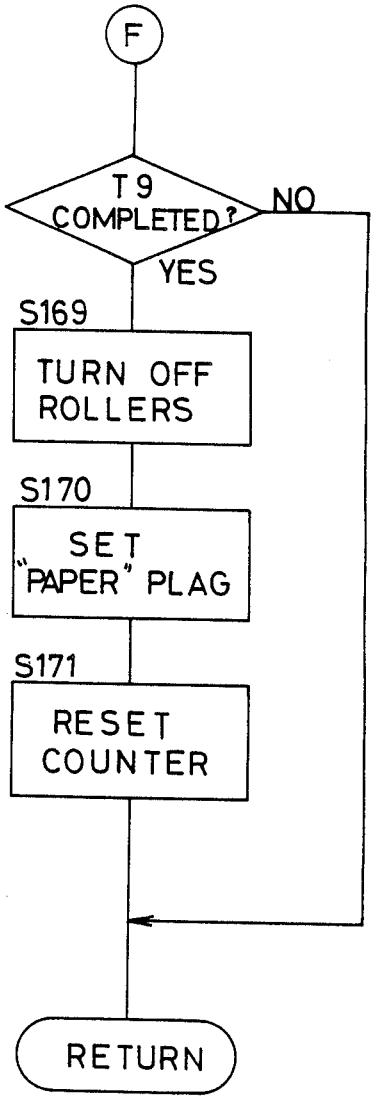
Figure 7H:
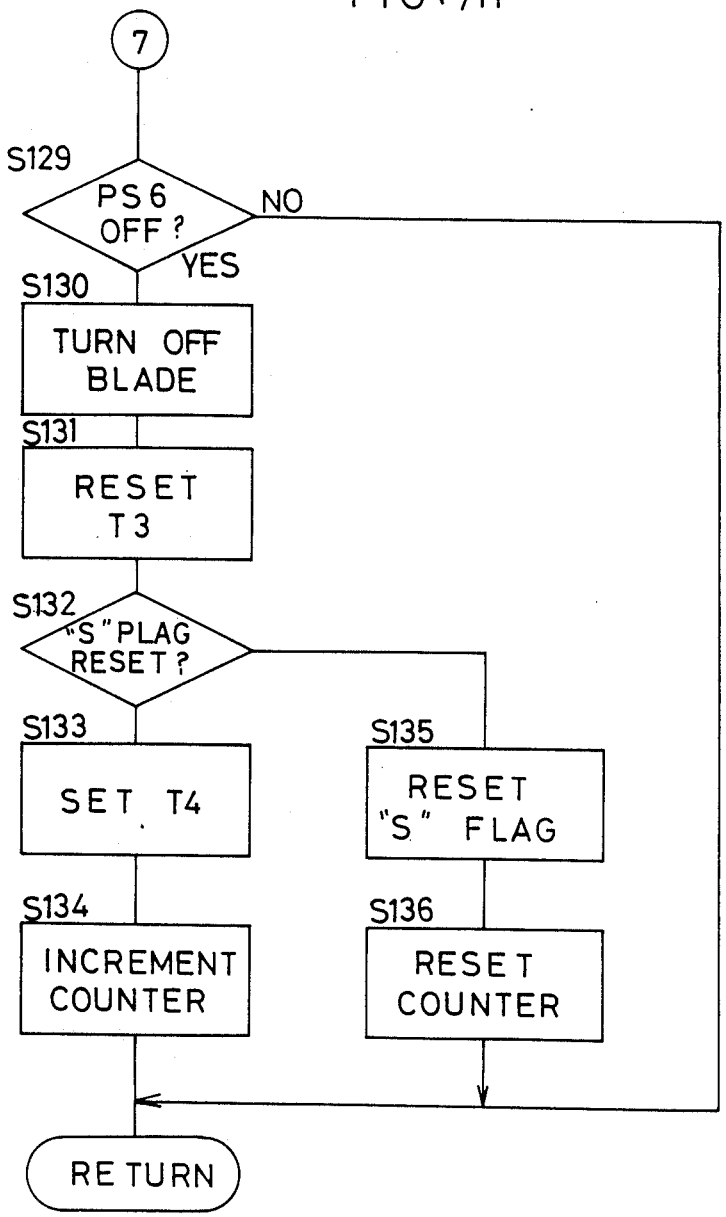
Figure 7I:
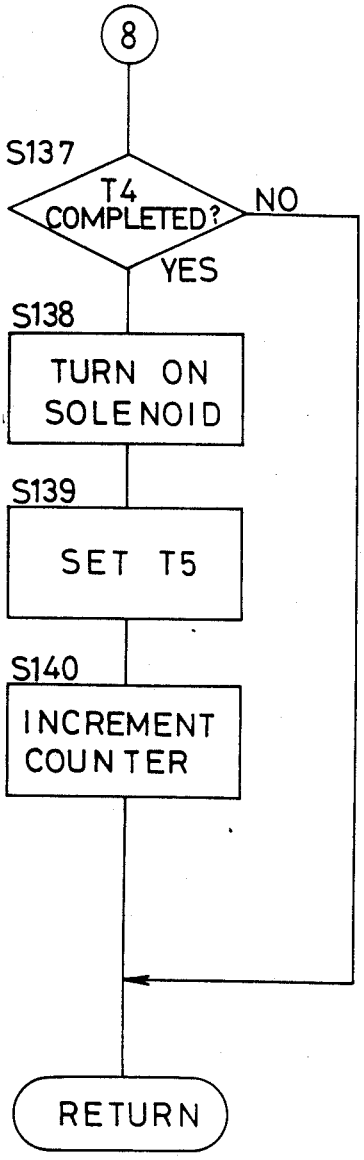
Figure 7J:
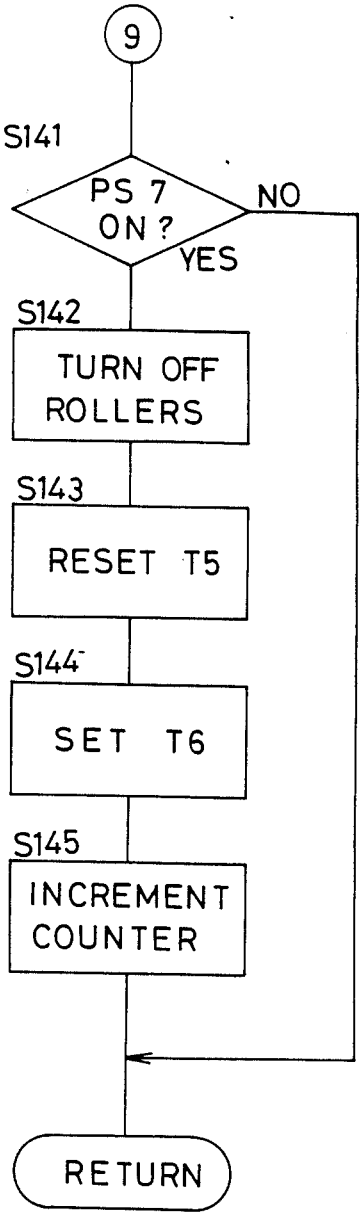
Figure 7K:
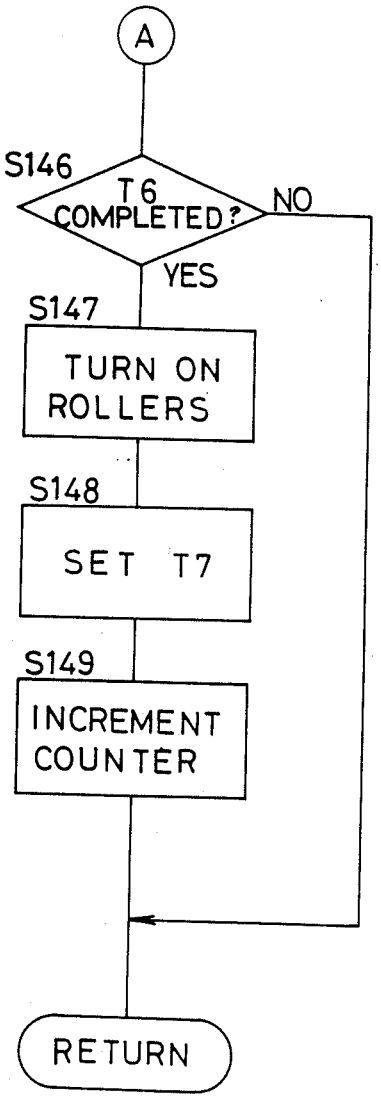
Figure 7M:
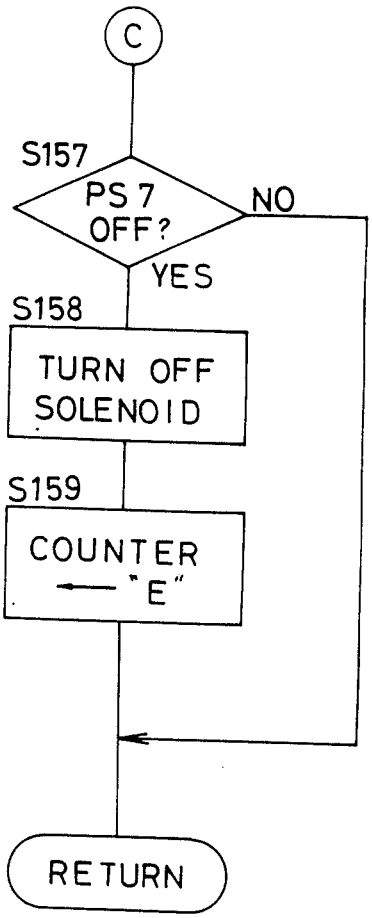
Figure 7N:
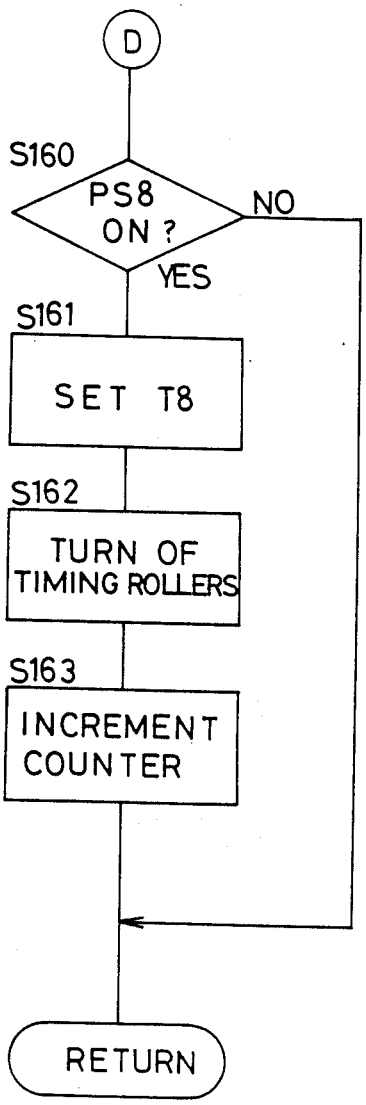
Figure 7O:
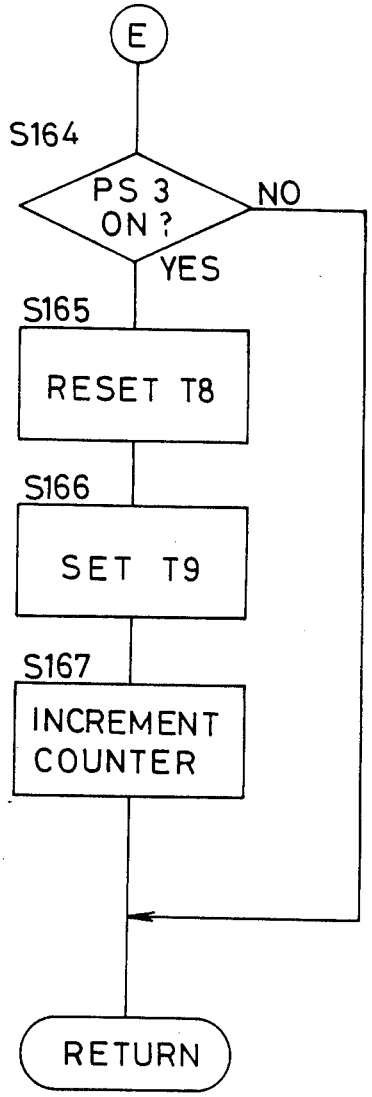

Step S8 of the main routine is for executing a control subroutine in the duplex and composite copying modes as already noted. FIG. 7 illustrate the control subroutine in one of these modes, i.e. the duplex copying mode. This control subroutine controls the various operating elements in accordance with input signals from the various sensors and others, to enable the copying machine to carry out a duplex copying operation.

First, step S101 checks whether the duplex copying mode is selected or not. If it is, step S101 checks a duplex state counter. This counter is settable to "0"–"9" and "A"–"F" and the program executes routines corresponding to these values as will be described hereinafter. This counter is initially set to "0".

Accordingly, when the counter is set to "0", a routine shown in FIG. *7a* is executed. At step S102, whether a paper feed has been started or not is checked. If it has, the program increments the duplex state counter to "1" at step S103 and returns to the main routine. The paper feed is carried out at Step S6 of the main routine in response to the copy request signal transmitted from CPU 100 to CPU 101.

When the duplex state counter is set to "1", step S104 in FIG. *7b* checks whether a regist signal is on or not. The regist signal is given from CPU 102 to CPU 101 for synchronizing the leading end of a sheet with the leading end of an image formed on the surface of photoreceptor drum 10. When the regist signal is output, the timing roller pair 40 is driven to feed a sheet in the standby position immediately upstream thereof to the transfer section. The program then moves to step S105 for setting a timer T1 for detecting a small size sheet and to step S106 for incrementing the duplex state counter to "2", and returns to the main routine. The timer T1 is for detecting the length of a sheet being transported, and is set by the RAM of CPU 100.

The sheet length is detected in this subroutine since a sheet shorter than a distance between any two of adjacent transport pairs 75, 61, 62 and 63 could result in a jam. The sheet size detection is carried out in the course of sheet transport because in this embodiment sheet sizes are not detected in the cassettes 30 and 35 and the sizes of manually fed sheets can be detected only in the course of sheet transport.

When the duplex state counter is set to "2", step S107 in FIG. *7c* checks whether the small size sheet detecting timer T1 has finished counting or not. If not, step S110 checks whether sensor PS3 is off. If sensor PS3 is on, that is if the sheet is passing through sensor PS3, the program returns to the main routine. In the event that timer T1 finishes counting while sensor PS3 remains in operation, the sheet being transported is judged to have a size fit for re-feed. Then, step S108 slightly turns the switching blade 71 clockwise from the solid line position in FIG. 1 for guiding the sheet to the vertical transport unit 70. Next, the program increments the duplex state counter to "3" at step S109 and returns to the main routine.

If step S110 finds sensor PS3 turned off before timer T1 finishes counting, the paper is judged to have a size unfit for re-feed. Then, step S111 sets a sheet size flag, and step S112 checks through switch SW7 whether the sorter 90 is connected or not. If the switch SW7 is on, indicating that the sorter 90 is connected, steps S108 and S109 are executed to guide the sheet to the vertical transport unit 70. If the switch SW7 is off, the program resets the duplex state counter to "0" at step S113 and returns to the main routine.

In other words, when the sheet size is unfit for re-feed and the sorter 90 is disconnected, the sheet is discharged to the tray T attached to the main body 1 as shown in FIG. 1B. In this case, the switching blade 71 is set to the solid line position in FIG. 1B for discharging the sheet through the discharge roller pair 73. On the other hand, when the sorter 90 is connected, the sheet is fed to the vertical transport unit 70 for forcible discharge to the discharge tray 76 as described later. This arrangement is made since, if the sheet were discharged immediately to the sorter 90, there would not be sufficient time for moving the sorter 90 to a position for receiving the sheet.

When the duplex state counter is set to "3", the program waits at step S114 in FIG. *7d* for sensor PS4 to be turned on, i.e. for the leading end of the sheet to arrive at the discharge roller pair 44. Then, at step S115, a timer T2 is set for detecting the leading end of the sheet trapped in the vertical transport path. The program increments the duplex state counter to "4" at step S116 and returns to the main routine. The timer T2 is set by the RAM of CPU 100, and is counted at step S11 of the main routine. When the counting is finished, it is judged to be a paper jam. This applies also to paper jam detecting timers described later.

When the duplex state counter is set to "4", step S117 in FIG. *7e* checks whether sensor PS4 is off or not. If it is off, namely if the rear end of the sheet has passed the discharged roller pair 44, a timer T3 is set at step S118 for detecting the rear end of the sheet trapped in the vertical transport path. The program increments the duplex state counter to "5" and returns to the main routine.

If step S117 finds sensor PS4 remaining in operation, which indicates that the sheet is advancing through the discharge roller pair 44, the program waits at step S120 for sensor PS6 to be turned on, i.e. for the leading end of the sheet to arrive at a position just short of the transport roller pair 75. Then, timer T2 is reset at step S121. The program returns to the main routine after setting the duplex state counter to "6" at step S122.

When the duplex state counter is set to "5", the program waits at step S123 in FIG. *7f* for sensor PS6 to be turned on. Then, the program resets timer T2 at step S124, sets the duplex state counter to "7", and returns to the main routine.

When the duplex state counter is set to "6", the program waits at step S117 in FIG. *7g* for sensor PS4 to be turned off, namely for the rear end of the sheet to pass the discharge roller pair 44. Then the program sets timer T3 at step S127 for detecting the rear end of the sheet trapped in the vertical transport path, increments the duplex state counter to "7" at step S128, and returns to the main routine.

When the duplex state counter is set to "7", the program waits at step S129 in FIG. *7h* for the sensor PS6 to be turned off, namely for the sheet to be nipped by the transport roller pair 75 and fed to the position between the guide plates 81 and 82. Then, at step S130, the switching blade is moved to the position for guiding sheets to the discharge roller pair 73. Next, the program resets timer T3 at step S131, and checks at step S132 whether a small sheet size flag is reset or not. If this flag is reset, the sheet is judged fit for re-feed. Then, step S133 sets a timer T4 for delaying a switchback start, and step S134 increments the duplex state counter to "8", which is followed by a return to the main routine.

If step S132 finds the small sheet size flag set (see step S111), this flag is reset at step S135, the duplex state counter is reset to "0" at step S136, and the program returns to the main routine. That is to say, if the sheet size is judged unfit for re-feed, the transport roller pair 75 is maintained in forward rotation to forcibly discharge the sheet onto the tray 75. At this time, CPU 101 transmits a duplex copying mode cancel signal to CPU 100, and the control panel gives an indication to that effect.

When the duplex state counter is set to "8", the program waits at step S137 in FIG. *7i* for the timer T4 to finish counting. Then, at step S138, the switchback solenoid is energized to put the transport roller pair 75 in backward rotation. This starts a re-feeding operation through the horizontal transport unit 60. Next, at step S139, a timer T5 is set for detecting a paper jam in the horizontal transport path. At step S140 the duplex state counter is incremented to "9", and the program returns to the main routine.

When the duplex state counter is set to "9", the program waits at step S141 in FIG. *7j* for the sensor PS7 to be turned on, namely for the leading end of the sheet to be fed to the horizontal transport unit 60. Then, at step S142, the transport roller pairs 61–63 are turned off. These roller pairs 61–63 are stopped in order to avoid a skew by properly placing the forward end of the switchback sheet at the nip of the transport roller pair 61. Thereafter, the program resets the paper jam detecting timer T5 at step S143, sets a timer T6 for forming a skew-proof loop at step S144, increments the duplex state counter to "A" at step S145, and returns to the main routine. The leading end of the sheet comes into contact with the nip of the transport roller pair 61 to form the loop while the timer T6 is counting, thereby to avoid a skew.

When the duplex state counter is set to "A", the program waits at step S146 in FIG. *7k* for the skew-proof loop forming timer T6 to finish counting. Then, at step S147, the transport roller pairs 61–63 are turned on. As a result, the sheet is transported through the horizontal transport unit 60 back to the timing roller pair 40. Thereafter, the program sets a first timer T7 at step S148 for detecting the forward end of the sheet trapped in the horizontal transport path up to sensor PS8, increments the duplex state counter to "B" at step S149, and returns to the main routine.

When the duplex state counter is set to "B", the program checks at step S150 in FIG. *7l* whether sensor PS8 is turned on or not. When sensor PS8 is turned on, namely when the leading end of the sheet reaches an outlet of the horizontal transport path, the program sets a second timer T8 at step S151 for detecting the leading end of the sheet trapped in the horizontal transport path up to sensor PS3. This resets the first timer T7. Then, step S152 turns off the timing roller pair 40 to keep the re-fed sheet in the standby state for a time. At step S153 the program increments the duplex state counter to "C", and returns to the main routine.

If step S150 finds sensor PS8 remaining out of operation, it is judged that the leading end of the sheet has not reached the outlet of horizontal transport unit 60. Then the program moves to step S154 to wait for sensor PS7 to be turned off. When the sensor PS7 is turned off, namely the rear end of the sheet is completely fed into the horizontal transport unit 60, step S155 switches the transport roller pair 75 to forward rotation by de-energizing the switchback solenoid. As a result, any sheet following in error the sheet fed to the horizontal transport unit 60 is discharged onto the discharge tray 76 by the transport roller pair 75 rotating forward. The program sets the duplex state counter to "D" at step S156 and returns to the main routine.

When the duplex state counter is set to "C", the program waits at step S157 in FIG. *7m* for the sensor PS7 to be turned off. When sensor PS7 is turned off, the program moves to step S158 and switches the transport roller pair 75 to forward rotation by de-energizing the switchback solenoid as at step S155. The program sets the duplex state counter to "E" at step S159 and returns to the main routine.

When the duplex state counter is set to "D", the program waits at step S160 in FIG. *7n* for the sensor PS8 to be turned on. When the sensor PS8 is turned on, the program moves to step S161 for setting the second timer T8. Thereafter, the program moves to step S162 for turning off the timing roller pair 40 and to step S163 for incrementing the duplex state counter to "E", and returns to the main routine.

When the duplex state counter is set to "E", the program waits at step S164 in FIG. *7o* for the sensor PS3 to be turned on, namely for the leading end of the sheet to reach the timing roller pair 40. When the sensor PS3 is turned on, the program moves to step S165 for resetting the second timer T8. Thereafter, the program moves to step S166 for setting a timer T9 for forming a loop upstream of the timing roller pair 40 and to step S167 for incrementing the duplex state counter, and returns to the main routine. While this timer T9 is counting, the leading end of the sheet comes into contact with the nip between the timing roller pair 40, thereby to avoid a skew.

When the duplex state counter is set to "F", the program waits at step S168 in FIG. *7p* for the loop forming timer T9 to finish counting. Then, at step S169 the transport roller pairs 61–62 are turned off. Next, the program moves to step S170 for setting the "sheet-in-horizontal-path" flag and to step S171 for resetting the duplex state counter to "0", and completes this subroutine.

Hereinbefore, only the duplex copying control routine executed at step S8 has been described in detail with reference to FIGS. 7 and *7a* through *7p*. The composite copying control routine is executed at step S8 in substantially the same way. In the composite copying mode, however, the second switching blade 72 is originally set to the position slightly turned clockwise from the solid line position in FIG. 1, and is controlled to move to the solid line position when the small sheet size flag is set.

The described embodiment may be modified in various ways. For example, if the sorter 90 is the type movable quickly, a sheet may be forcibly discharged to the sorter 90 when the sheet is judged to have a size unfit for re-feed.

Furthermore, the sorter 90 may be replaced by a stapler or other sheet handling devices.

SECOND EMBODIMENT

Figure 8:
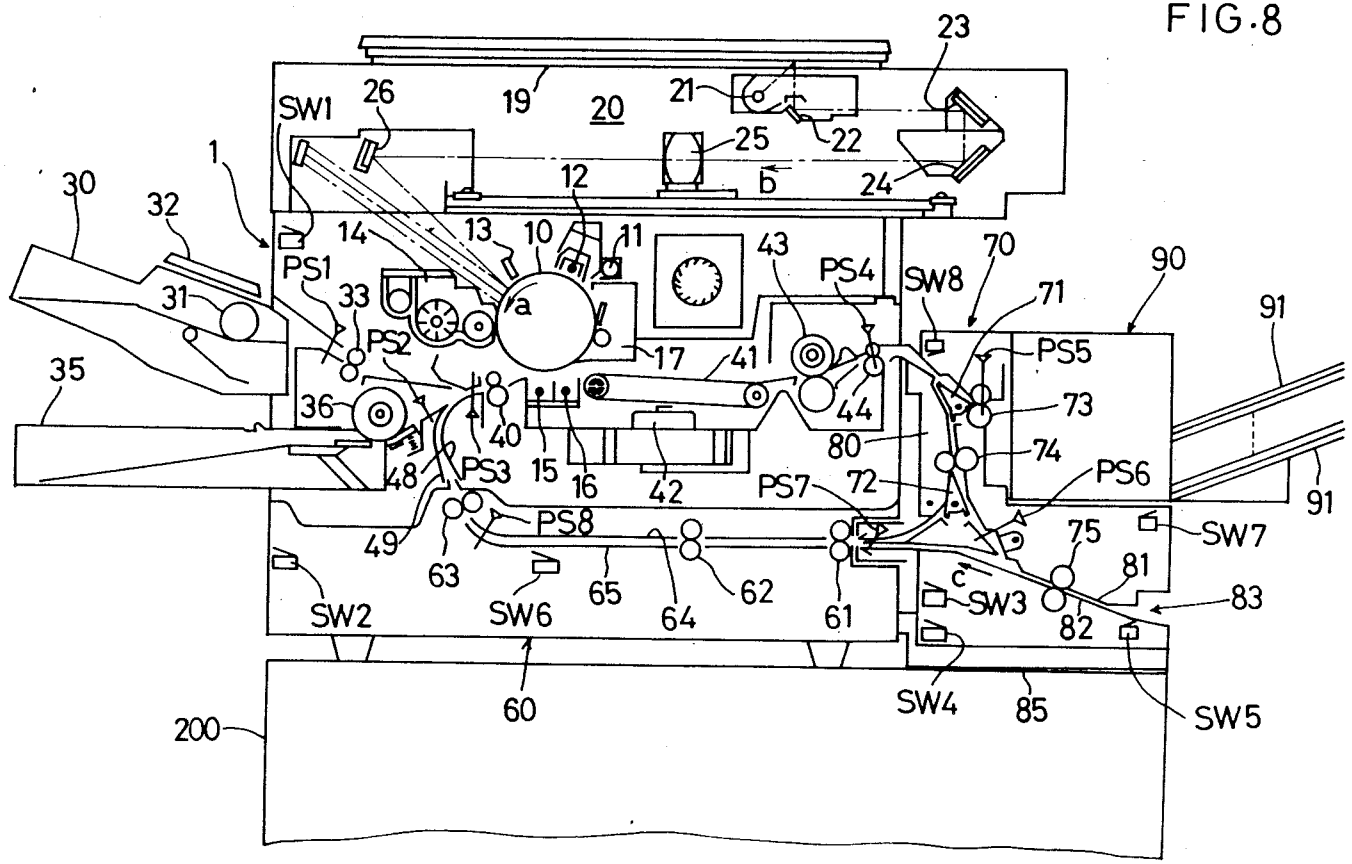
FIG. 8 is a schematic view of a copying apparatus according to another embodiment of the invention.

FIG. 8 shows a copying machine according to the second embodiment of the invention. This embodiment differs from the first embodiment shown in FIGS. 1A and 1B in that the discharge tray 76 attached adjacent the reversible transport roller pair 75 is now omitted. The components of this embodiment affixed with the same reference numerals as in the first embodiment have the same functions as their counterparts, and will not be described again.

As illustrated, this copying machine usually is mounted on a a base 200 specially designed for the purpose. If a sheet is found to have a size unfit for re-feed in the duplex or composite copying mode, the sheet is discharged outwardly of the machine through the transport roller pair 75 in the forcible discharge mode. It will be undesirable for the discharged sheet to just fall to the floor; such sheets will be unsightly. Thus, the second embodiment provides means for stopping the transport roller pair 75 in order to hold the sheet against falling to the floor. This forcible discharge will be described hereinafter in relation to the duplex and composite copying modes.

In the duplex and composite copying modes, the first switching blade 71 is set to the position slightly displaced clockwise from the solid line position. As a result, the sheet is guided to the transport roller pair 74. In the duplex copying mode, the second switching blade 72 is set to the solid line position and the sheet is transported by the transport roller pair 75 in forward rotation to the position between guide plates 81 and 82. The sheet is temporarily stopped as nipped by the transport roller pair 75. When an unillustrated solenoid is electrified, the transport roller pair 75 is driven backward to transport the sheet in the direction of arrow c in a switchback fashion onto the horizontal transport unit 60. Subsequently, the sheet is transported to the timing roller pair 40 to be subjected to the copying operation for printing an image on the back face of the sheet. This transport roller pair 75 is driven backward only for re-feeding in the duplex copying mode. At other times the roller pair 75 is driven forward to discharge papers through an opening 83.

In the composite copying mode, the second switching blade 72 is set to the position slightly displaced clockwise from the solid line position. As a result, the sheet is transported from the transport roller pair 74 directly to the horizontal transport unit 60. Thereafter, the sheet is transported to the timing roller pair 40 for superposing a second image on a first image on the front face thereof.

If a sheet having a size unfit for re-feeding is introduced for an operation in the duplex or composite copying mode, the sheet carrying a copy image on one face thereof is transported through the transport roller pair 74 to the transport roller pair 75. At this time the transport roller pair 75 is maintained in forward rotation to discharge the sheet outwardly through the opening 83. The transport roller pair 75 is stopped when the sheet reaches a position protruding from the opening 83. Thus, the sheet is retained by the transport roller pair 83 so as to protrude from the opening 83. The operator may then just pull out the sheet.

Figure 9:
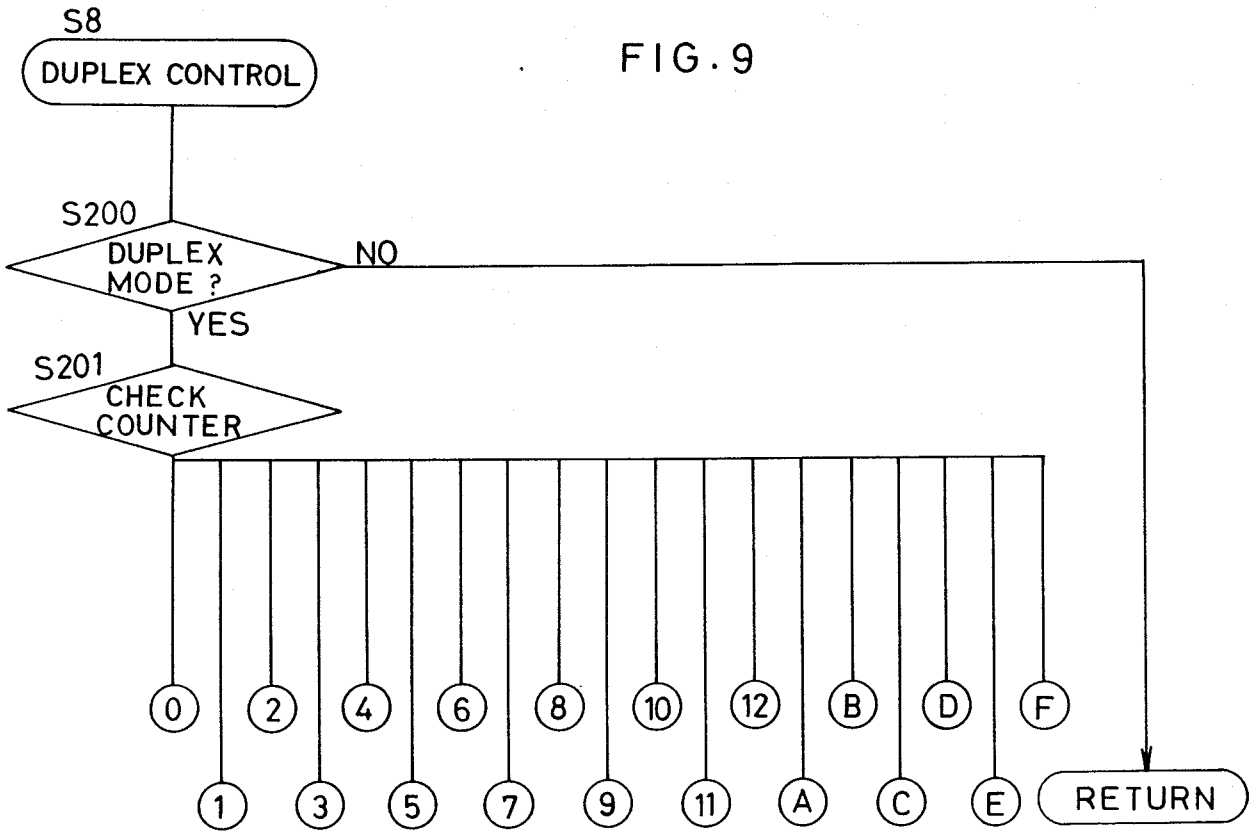
FIGS. 9 and 9*a* through 9*s* are a flowchart of a duplex copying control subroutine for the copying apparatus shown in FIG. 8.

The second embodiment is basically the same as the first embodiment in the Control Circuitry and Control Sequence. The second embodiment is operable in accordance with a control routine for the duplex copying mode as illustrated in FIG. 9. This control routine is different in certain aspects from the corresponding routine described hereinbefore, and will be described below. The composite copying mode is also controlled by this routine, but in this case the only difference lies in the movement of the second switching blade 72 and its description is omitted.

Figure 9A:
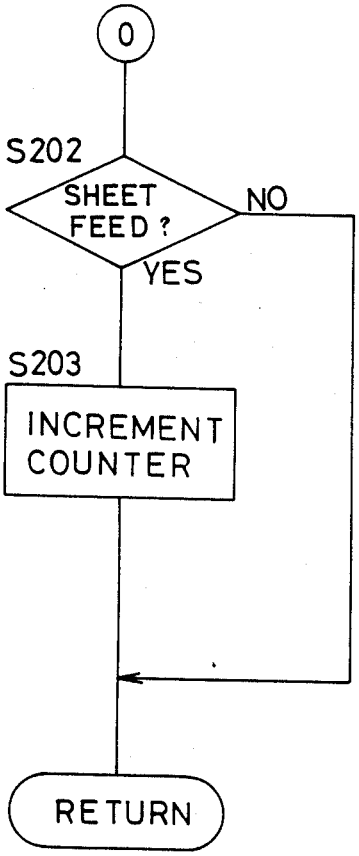

When the duplex copying control subroutine is called at step S8 in FIG. 4, step S200 first checks whether the duplex copying mode is selected or not as shown in FIG. 9. If it is, step S201 checks the duplex state counter. This counter is settable to "0"–"9" and "A'-'–"F" and the program executes routines corresponding to these values as shown in FIGS. 9*a*–9*s*. This counter is initially set to "0".

Accordingly, when the counter is set to "0", a routine shown in FIG. 9*a* is executed. At step S202, whether a paper feed has been started or not is checked. If it has, the program increments the duplex state counter to "1" at step S203 and returns to the main routine. The paper feed is carried out at step S6 of the main routine in response to the copy request signal transmitted from CPU 100 to CPU 101.

Figure 9B:
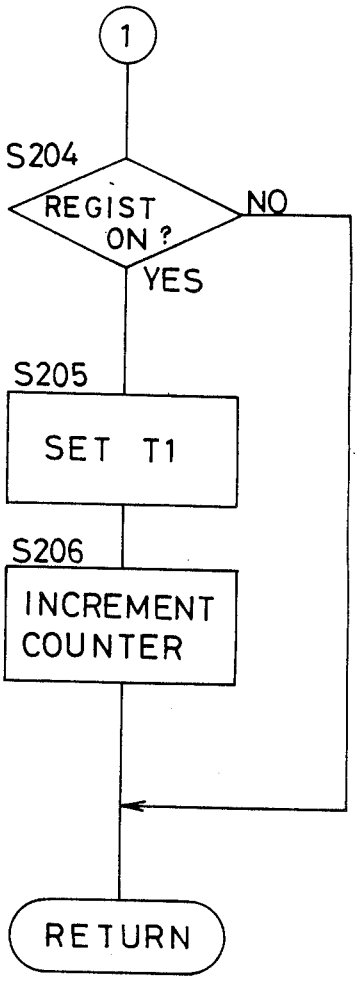

When the duplex state counter is set to "1", step S204 in FIG. 9*b* checks whether a regist signal is on or not. The regist signal is given from CPU 102 to CPU 101 for synchronizing the leading end of a sheet with the leading end of an image formed on the surface of photoreceptor drum 10. When the regist signal is output, the timing roller pair 40 is driven to feed a sheet in the standby position immediately upstream thereof to the transfer section. The program then moves to step S205 for setting the timer T1 for detecting a small size sheet and to step S206 for incrementing the duplex state counter to "2", and returns to the main routine. The timer T1 is for detecting the length of a sheet being transported, and is set by the RAM of CPU 100.

The sheet length is detected in this subroutine since a sheet shorter than a distance between any two of adjacent transport pairs 75, 61, 62 and 63 could result in a jam. The sheet size detection is carried out in the course of sheet transport because in this embodiment sheet sizes are not detected in the cassettes 30 and 35 and the sizes of manually fed sheets can be detected only in the course of sheet transport.

Figure 9C:
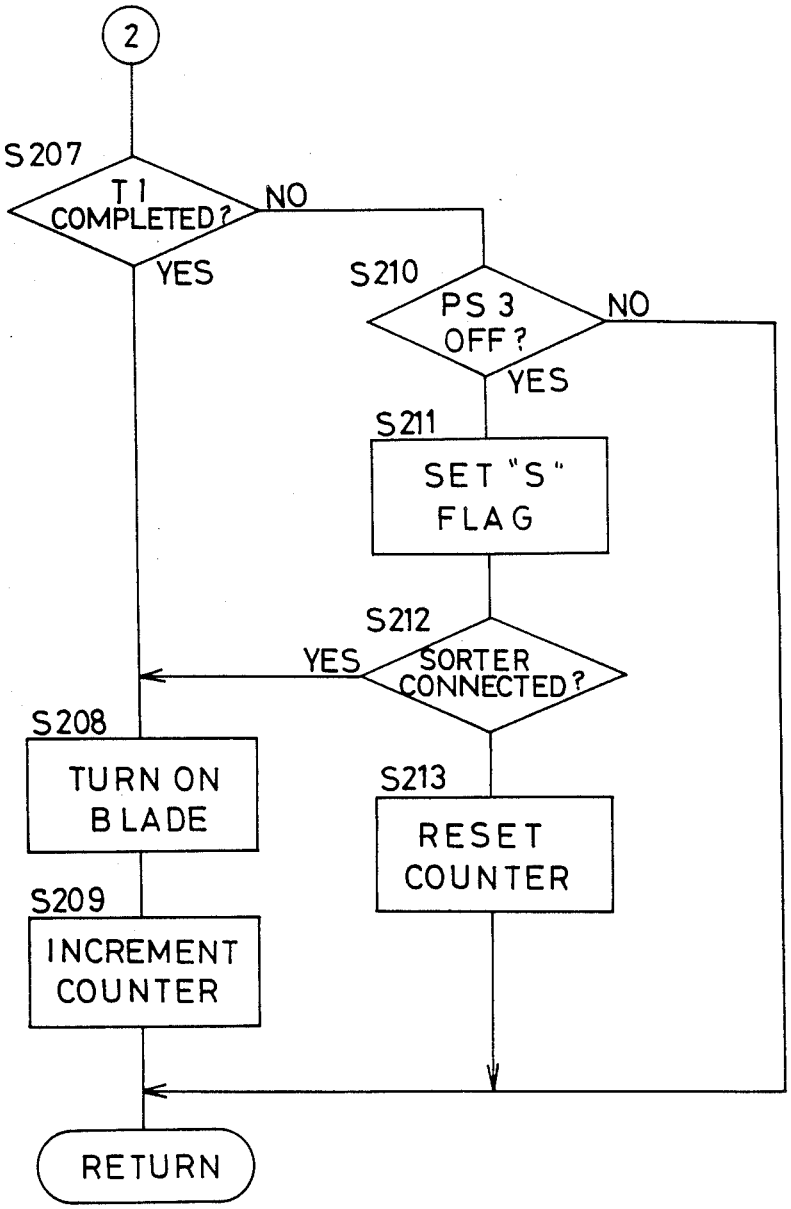

When the duplex state counter is set to "2", step S207 in FIG. 9*c* checks whether the small size sheet detecting timer T1 has finished counting or not. If not, step S210 checks whether sensor PS3 is off. If sensor PS3 is on, that is if the sheet is passing through sensor PS3, the program returns to the main routine. In the event that timer T1 finishes counting while sensor PS3 remains in operation, the sheet being transported is judged to have a size fit for re-feed. Then, step S208 slightly turns the switching blade 71 clockwise from the solid line position in FIG. 8 for guiding the sheet to the vertical transport unit 70. Next, the program increments the duplex state counter to "3" at step S209 and returns to the main routine.

If step S210 finds sensor PS3 turned off before timer T1 finishes counting, the paper is judge to have a size unfit for re-feed. Then, step S211 sets a sheet size flag, and step S212 checks through switch SW7 whether the sorter 90 is connected or not. If the switch SW7 is on, indicating that the sorter 90 is connected, steps S208 and S209 are executed to guide the sheet to the vertical transport unit 70. If the switch SW7 is off, the program resets the duplex state counter to "0" at step S213 and returns to the main routine.

In other words, when the sheet size is unfit for re-feed and the sorter 90 is disconnected, the sheet is discharged to the tray T attached to the main body 1 (FIG. 1B). In this case, the switching blade 71 is set to the solid line position for discharging the sheet through the discharge roller pair 73. On the other hand, when the sorter 90 is connected, the sheet is fed to the vertical transport unit 70 for forcible discharge to the discharge tray 76 as described later. This arrangement is made since, if the sheet were discharged immediately to the sorter 90, there would not be sufficient time for moving the sorter 90 to a position for receiving the sheet.

Figure 9D:
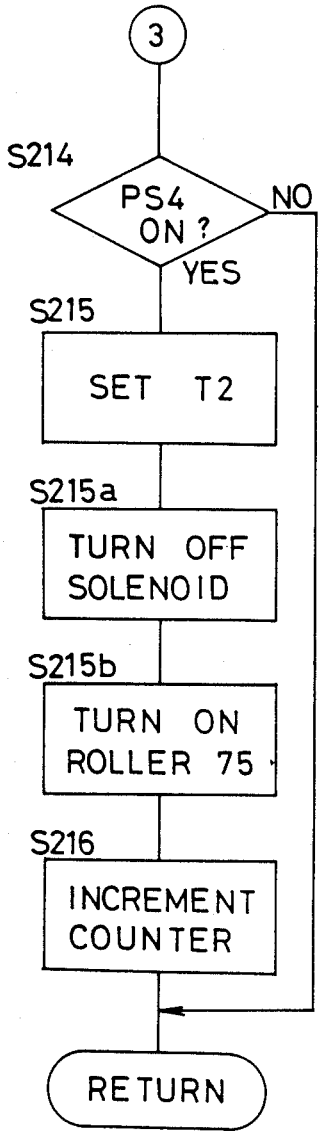
Figure 9F:
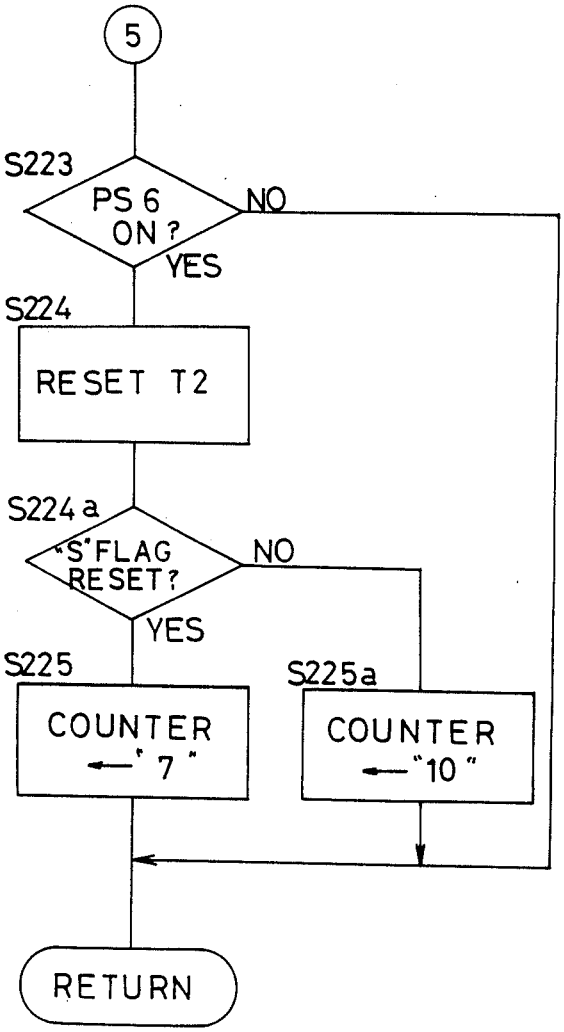

When the duplex state counter is set to "3", the program waits at step S214 in FIG. 9*d* for sensor PS4 to be turned on, i.e. for the leading end of the sheet to arrive at the discharge roller pair 44. Then, at step S215, the timer T2 is set for detecting the leading end of the sheet trapped in the vertical transport path. This timer T2 is set by the RAM of CPU 100, and is counted at step S11 of the main routine shown in FIG. 4. When the counting is finished, it is judged to be a paper jam. This applies also to paper jam detecting timers described later.

Next, the switchback solenoid is turned off at step S215*a*, and the transport roller pair 75 is turned on at step S215*b* to rotate forward for transporting the sheet to the opening 83. At step S216 the duplex state counter is incremented to "4", and the program returns to the main routine.

Figure 9E:
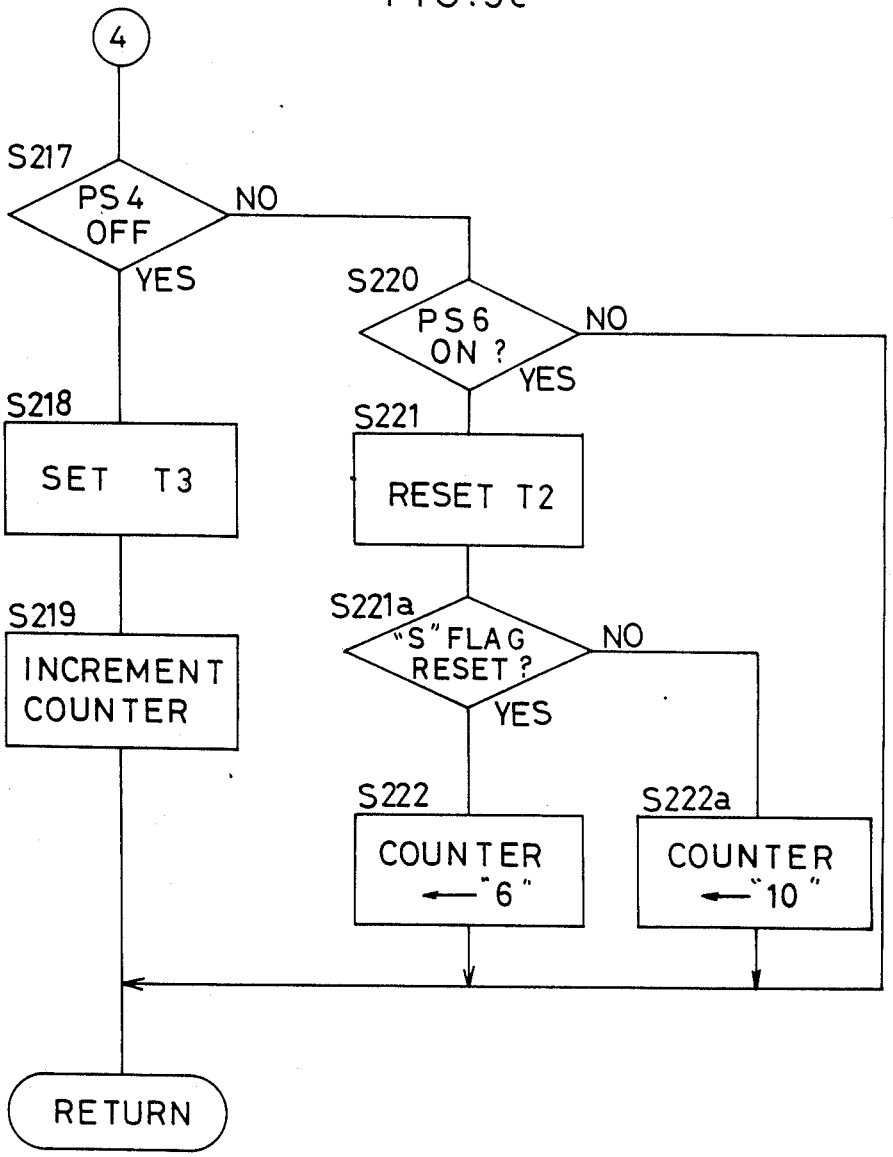

When the duplex state counter is set to "4", step S217 in FIG. 9*e* checks whether sensor PS4 is off or not. If it is off, namely if the rear end of the sheet has passed the discharge roller pair 44, timer T3 is set at step S218 for detecting the rear end of the sheet trapped in the vertical transport path. The program increments the duplex state counter to "5" and returns to the main routine.

If step S217 finds sensor PS4 remaining in operation, which indicates that the sheet is advancing through the discharge roller pair 44, the program waits at step S220 for sensor PS6 to be turned on, i.e. for the leading end of the sheet to arrive at a position just short of the transport roller pair 75. Then, timer T2 is reset at step S221.

Next, whether the small sheet size flag is reset or not is checked at step S221*a*. If the flag is reset, the sheet has a size fit for re-feed. Then the program returns to the main routine after setting the duplex state counter to "6" at step S222. If, on the other hand, the above flag is set, the sheet has a size unfit for re-feed. Then the program returns to the main routine after setting the duplex state counter to "10" at step S222*a*.

When the duplex state counter is set to "5", the program waits at step S223 in FIG. 9*f* for sensor PS6 to be turned on. Then, the program resets timer T2 at step S224, and checks at step S224*a* whether the small sheet size flag is reset or not. If this flag is reset, the program sets the duplex state counter to "7", and returns to the main routine. If the above flag is set, the program returns to the main routine after setting the duplex counter to "10" at step S225*a* as at step S222*a*.

Figure 9G:
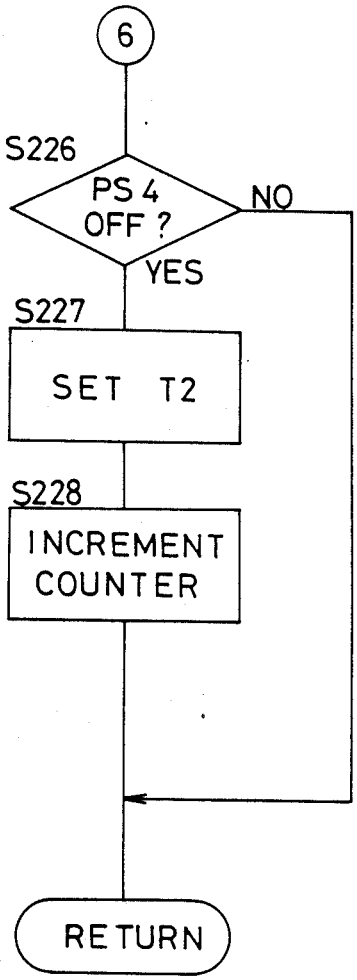

When the duplex state counter is set to "6", the program waits at step S217 in FIG. 9*g* for sensor PS4 to be turned off, namely for the rear end of the sheet to pass the discharge roller pair 44. Then the program sets timer T3 at step S227 for detecting the rear end of the sheet trapped in the vertical transport path, increments the duplex state counter to "7" at step S228, and returns to the main routine.

Figure 9H:
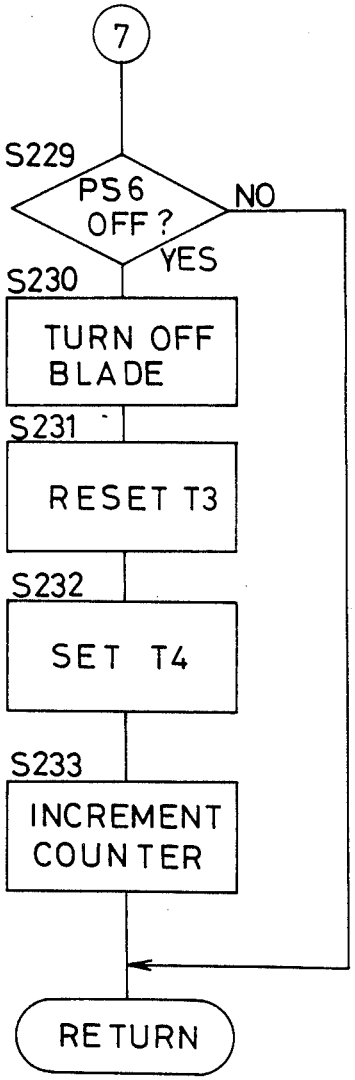

When the duplex state counter is set to "7", the program waits at step S229 in FIG. 9*h* for the sensor PS6 to be turned off, namely for the sheet to be nipped by the transport roller pair 75 and fed to the position between the guide plates 81 and 82. Then, at step S230, the switching blade is moved to the position for guiding sheets to the discharge roller pair 73. Next, the program resets timer T3 at step S231, sets the switchback start delaying timer T4 at step S232, increments the duplex state counter to "8" at step S233, and returns to the main routine.

Figure 9I:
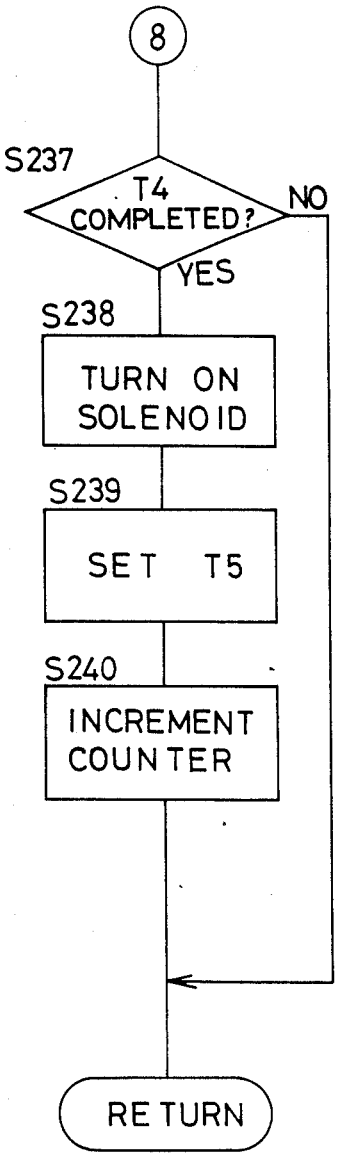

When the duplex state counter is set to "8", the program waits at step S237 in FIG. 9*i* for the timer T4 to finish counting. Then, at step S238, the switchback solenoid is energized to put the transport roller pair 75 in backward rotation. This starts a re-feeding operation through the horizontal transport unit 60. Next, at step S239, the timer T5 is set for detecting a paper jam in the horizontal transport path. At step S240 the duplex state counter is incremented, and the program returns to the main routine.

Figure 9J:
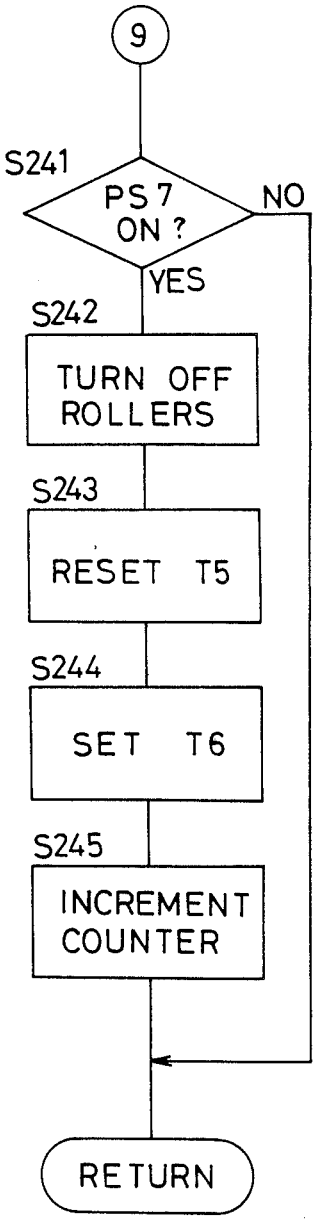

When the duplex state counter is set to "9", the program waits at step S241 in FIG. 9*j* for the sensor PS7 to be turned on, namely for the leading end of the sheet to be fed to the horizontal transport unit 60. Then, at step S242, the transport roller pairs 61–63 are turned off. These roller pairs 61–63 are stopped in order to avoid a skew by properly placing the forward end of the switchback sheet at the nip of the transport roller pair 61. Thereafter, the program resets the paper jam detecting timer T5 at step S243, sets timer T6 for forming a skew-proof loop at step S244, increments the duplex state counter to "A" at step S245, and returns to the main routine. The leading end of the sheet comes into contact with the nip of the transport roller pair 61 to form the loop while the timer T6 is counting, thereby to avoid a skew.

Figure 9K:
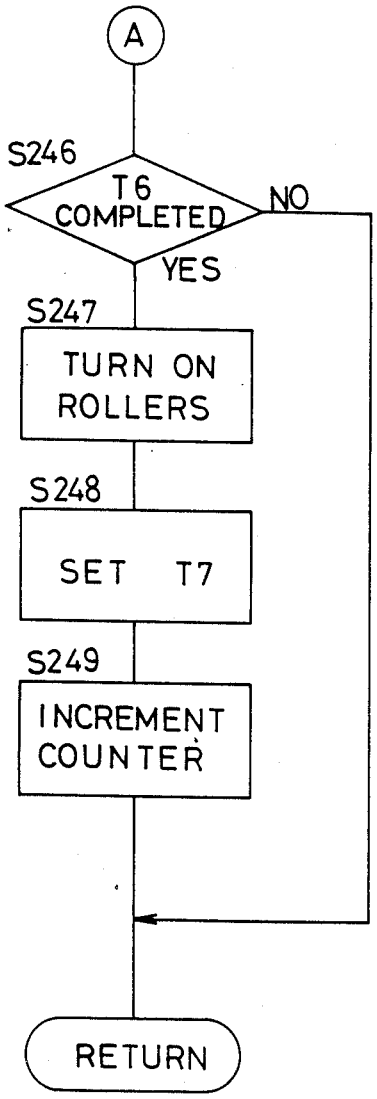

When the duplex state counter is set to "A", the program waits at step S246 in FIG. 9*k* for the skew-proof loop forming timer T6 to finish counting. Then, at step S247, the transport roller pairs 61–63 are turned on. As a result, the sheet is transported through the horizontal transport unit 60 back to the timing roller pair 40. Thereafter, the program sets the first timer T7 at step S248 for detecting the forward end of the sheet trapped in the horizontal transport path up to sensor PS8, increments the duplex state counter to "B" at step S249, and returns to the main routine.

When the duplex state counter is set to "B", the program checks at step S250 in FIG. 91 whether sensor PS8 is turned on or not. When sensor PS8 is turned on, namely when the leading end of the sheet reaches the outlet of the horizontal transport path, the program sets the second timer T8 at step S251 for detecting the leading end of the sheet trapped in the horizontal transport path up to sensor PS3. This resets the first timer T7. Then, step S252 turns off the timing roller pair 40 to keep the re-fed sheet in the standby state for a time. At step S253 the program increments the duplex state counter to "C", and returns to the main routine.

If step S250 finds sensor PS8 remaining out of operation, it is judged that the leading end of the sheet has not reached the outlet of horizontal transport unit 60. Then the program moves to step S254 to wait for sensor PS7 to be turned off. When the sensor PS7 is turned off, namely the rear end of the sheet is completely fed into the horizontal transport unit 60, step S255 switches the transport roller pair 75 to forward rotation by de-electrifying the switchback solenoid. As a result, any sheet following in error the sheet fed to the horizontal transport unit 60 or inserted through the opening 83 is discharged through the opening 83 by the transport roller pair 75 rotating forward. The program sets the duplex state counter to "D" at step S256 and returns to the main routine.

Figure 9M:
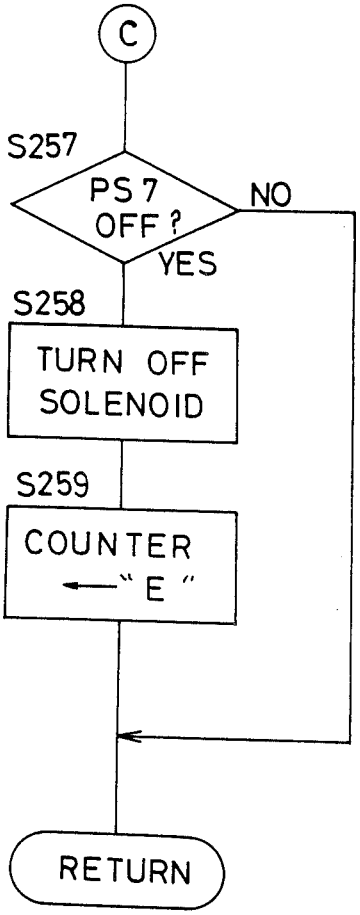

When the duplex state counter is set to "C", the program waits at step S257 in FIG. 9*m* for the sensor PS7 to be turned off. When sensor PS7 is turned off, the program moves to step S258 and switches the transport roller pair 75 to forward rotation by de-electrifying the switchback solenoid as at step S255. The program sets the duplex state counter to "E" at step S259 and returns to the main routine.

Figure 9N:
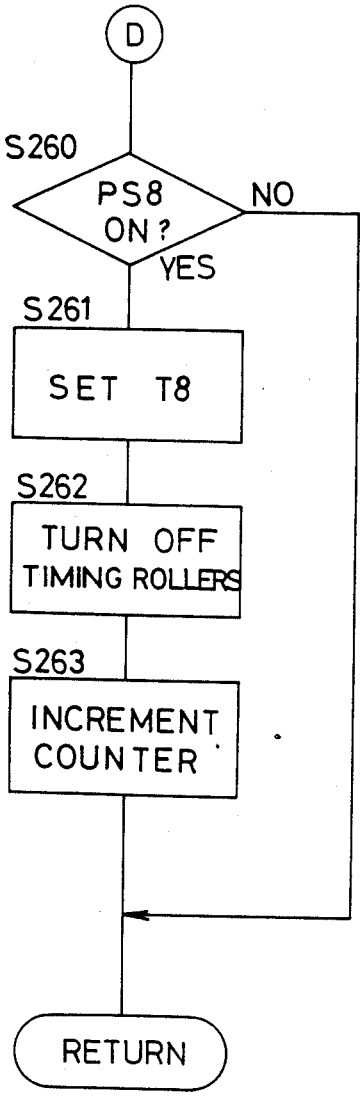

When the duplex state counter is set to "D", the program waits at step S260 in FIG. 9*n* for the sensor PS8 to be turned on. When the sensor PS8 is turned on, the program moves to step S261 for setting the second timer T8. Thereafter, the program moves to step S262 for turning off the timing roller pair 40 and to step S263 for incrementing the duplex state counter to "E", and returns to the main routine.

Figure 9O:
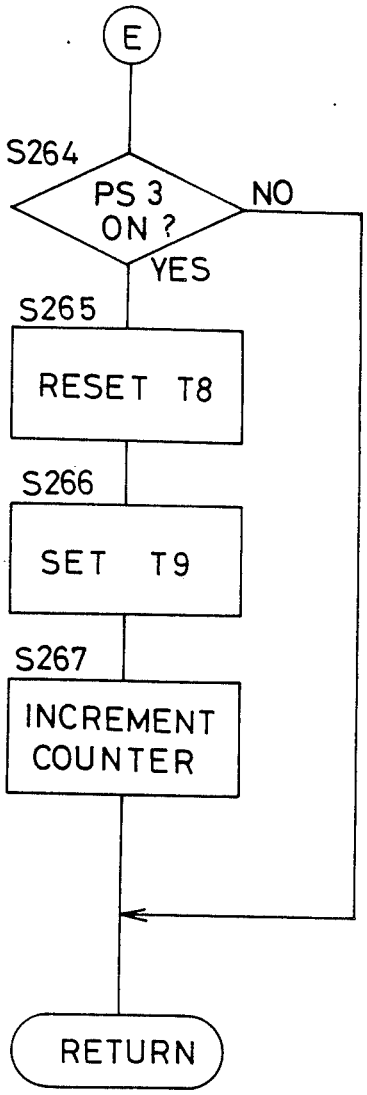

When the duplex state counter is set to "E", the program waits at step S264 in FIG. 9*o* for the sensor PS3 to be turned on, namely for the leading end of the sheet to reach the timing roller pair 40. When the sensor PS3 is turned on, the program moves to step S265 for resetting the second timer T8. Thereafter, the program moves to step S266 for setting timer T9 for forming a loop upstream of the timing roller pair 40 and to step S267 for incrementing the duplex state counter, and returns to the main routine. While this timer T9 is counting, the leading end of the sheet comes into contact with the nip between the timing roller pair 40, thereby to avoid a skew.

Figure 9P:
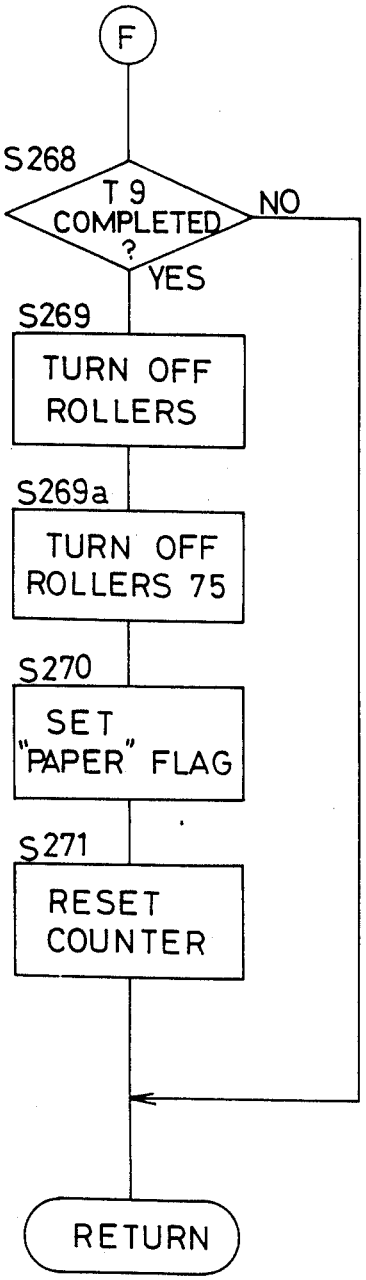

When the duplex state counter is set to "F", the program waits at step S268 in FIG. 9*p* for the loop forming timer T9 to finish counting. Then, at step S269 the transport roller pairs 61–62 are turned off. Next, the program moves to step S270 for setting the "sheet-in-horizontal-path" flag and to step S271 for resetting the duplex state counter to "0", and returns to the main routine.

Figure 9Q:
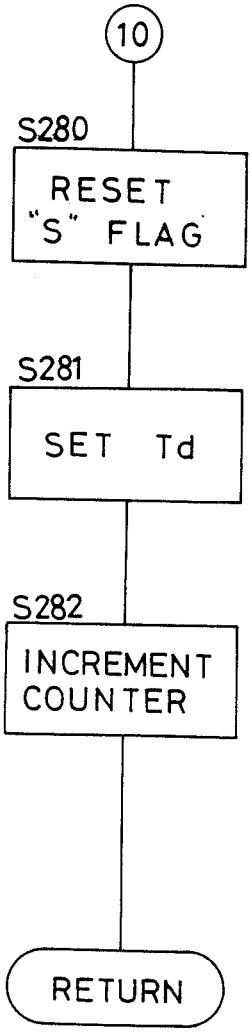

When the duplex state counter is set to "10", namely when the fed sheet has a size unfit for re-feed, the program resets the small sheet size flag at step S280 in FIG. 9*q*. Then, the program moves to step S281 for setting a stop delay timer Td for the transport roller pair 75 and to step S282 for incrementing the duplex state counter to "11", and returns to the main routine.

Figure 9R:
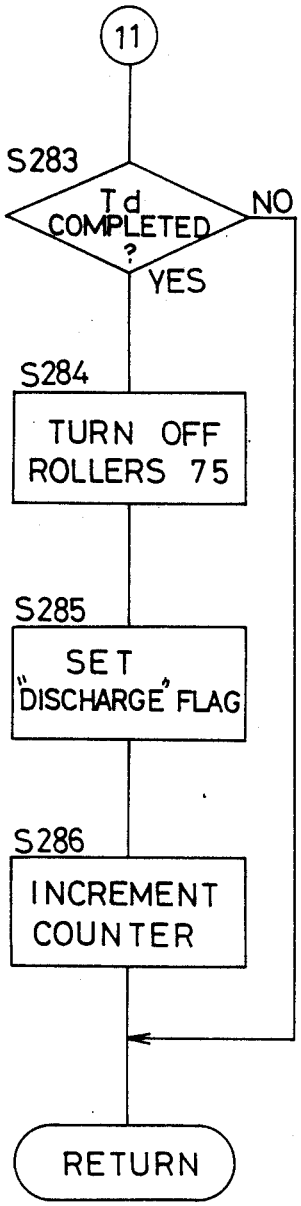
Figure 9S:
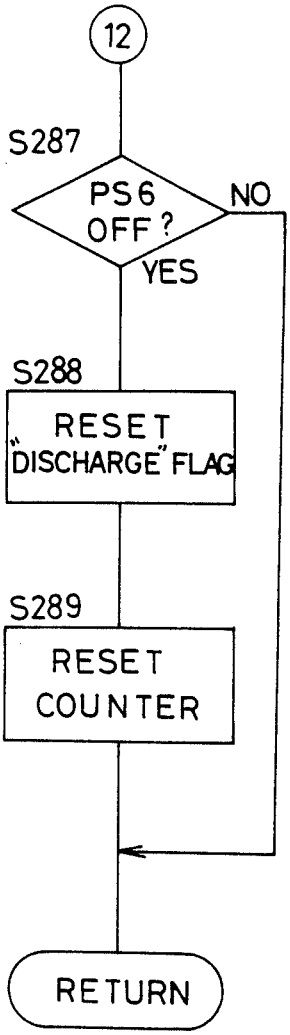

When the duplex state counter is set to "11", the program waits at step S283 in FIG. 9*r* for the delay timer Td to finish counting. After the timer Td finishes counting, the program moves to step S284 for turning off the transport roller pair 75 which then stops rotating forward. As a result, the sheet unfit for re-feeding is stopped as supported at the rear end thereof by the transport roller pair 75, with the leading end of the sheet projecting from the opening 83. At the same time, sensor PS6 remains in operation (i.e. in the sheet detecting state).

Next, the program sets a "forcible-discharge-sheet-present" flag at step S285, increments the duplex state counter to "12" at step S286, and returns to the main routine.

When this "forcible-discharge-sheet-present" flag is set, CPU 101 outputs a copy prohibit signal to CPU 100, whereby the duplex copying mode is cancelled and a next copying operation is prohibited. Simultaneously, an indication is given on the control panel that a sheet should be removed from the opening 83.

When the duplex state counter is incremented to "12", the program checks at step S287 in FIG. 9*s* whether sensor PS6 is off. The sensor PS6 is turned off when the unfit sheet is pulled out of the opening 83. Accordingly, when sensor PS6 is turned off, the program resets the "forcible-discharge-sheet-present" flag at step S288 and resets the duplex state counter to "0".

The image forming apparatus according to the present invention is not limited to the described embodiments. For example, whether the unfit sheet has been removed from the opening 83 may be judged by means of a sensor specially provided for the purpose instead of referring to the on/off operation of sensor PS6. However, where sensor PS6 is used for this purpose as well, the number of sensors may be small.

Although the present invention has been fully described by way of example with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus comprising:
sheet feed means;
size evaluating means for evaluating a size of a sheet transported by said sheet feed means;
image forming means for forming an image on the sheet transported by said sheet feed means;
a first sheet discharge section for discharging the sheet;
a second sheet discharge section provided separately from said first sheet discharge section;
sheet re-feed means for transporting the sheet having one side thereof formed with the image by said image forming means to said image forming means again, said sheet re-feeding means including a switchback transport roller pair rotatable in a first direction for feeding the sheet toward said image forming means and in a second direction opposite to said first direction for feeding the sheet toward the second discharge section;
control means for providing at least a sheet re-feeding mode for transporting the sheet having one side thereof formed with the image by said image forming means to said image forming means again and then transporting the sheet to said first sheet discharge section, said control means being operable in said re-feeding mode to deliver the sheet to said second sheet discharge section without delivering the sheet to said first sheet discharge section when said size evaluating means judges the sheet to be unfit for re-feed.

2. An image forming apparatus as claimed in claim 1, wherein said control means is operable, when rotating said roller pair for feeding the sheet toward the second discharge section, to stop said roller pair at a position for supporting the sheet such that the sheet extends outwardly of said second discharge section.

3. An image forming apparatus as claimed in claim 1, wherein said switchback transport roller pair is driven in the first direction only for re-feeding in the duplex copying mode whereas said roller pair being otherwise driven in the second direction for delivering the sheet to said second sheet discharge section.

4. An image forming apparatus comprising:
sheet feed means;
size evaluating means for evaluating a size of a sheet transported by said sheet feed means;

image forming means for forming an image on the sheet transported by said sheet feed means;

sheet re-feed means for transporting the sheet having one side thereof formed with the image by said image forming means to said image forming means again;

a first sheet discharge section for discharging the sheet;

sheet handling means connectable to said first sheet discharge section;

a second sheet discharge section provided separately from said first sheet discharge section; and control means for providing at least a sheet re-feed mode for transporting the sheet having one side thereof formed with the image by said image forming means to said image forming means again and then transporting the sheet to said first sheet discharge section, said control means being operable in said re-feed mode to deliver the sheet to said first sheet discharge section without delivering the sheet to said second sheet discharge section when said sheet handling means is disconnected from said first discharge section and said size evaluating means judges the sheet to be unfit for re-feed, and to deliver the sheet to said second sheet discharge section without delivering the sheet to said first sheet discharge section when said sheet handling means is connected to said first discharge section and said size evaluating means judges the sheet to be unfit for re-feed.

5. An image forming apparatus as claimed in claim 4, wherein said sheet handling means comprises a sheet sorter.

6. An image forming apparatus as claimed in claim 4, wherein said sheet handling means comprises a finisher such as a stapler.

* * * * *